US011072050B2

(12) United States Patent
Fu et al.

(10) Patent No.: US 11,072,050 B2
(45) Date of Patent: Jul. 27, 2021

(54) POLISHING PAD WITH WINDOW AND MANUFACTURING METHODS THEREOF

(71) Applicant: Applied Materials, Inc., Santa Clara, CA (US)

(72) Inventors: Boyi Fu, San Jose, CA (US); Sivapackia Ganapathiappan, Los Altos, CA (US); Daniel Redfield, Morgan Hill, CA (US); Rajeev Bajaj, Fremont, CA (US); Ashwin Chockalingam, Santa Clara, CA (US); Dominic J. Benvegnu, La Honda, CA (US); Mario Dagio Cornejo, San Jose, CA (US); Mayu Yamamura, San Mateo, CA (US); Nag B. Patibandla, Pleasanton, CA (US); Ankit Vora, San Jose, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 450 days.

(21) Appl. No.: 16/050,442

(22) Filed: Jul. 31, 2018

(65) Prior Publication Data

US 2019/0047112 A1 Feb. 14, 2019

Related U.S. Application Data

(60) Provisional application No. 62/562,237, filed on Sep. 22, 2017, provisional application No. 62/541,497, filed on Aug. 4, 2017.

(51) Int. Cl.

| | |
|---|---|
| ***B24B 37/20*** | (2012.01) |
| ***B24B 37/26*** | (2012.01) |
| ***B24B 37/24*** | (2012.01) |

(52) U.S. Cl.
CPC ..... *B24B 37/205* (2013.01); *B24B 37/245* (2013.01); *B24B 37/26* (2013.01)

(58) Field of Classification Search
CPC ..... B24B 37/205; B24B 37/245; B24B 37/26
See application file for complete search history.

(56) References Cited

U.S. PATENT DOCUMENTS

| | | | |
|---|---|---|---|
| 3,741,116 | A | 6/1973 | Green et al. |
| 4,575,330 | A | 3/1986 | Hull |

(Continued)

FOREIGN PATENT DOCUMENTS

| | | | |
|---|---|---|---|
| CN | 101199994 | A | 6/2008 |
| CN | 104210108 | A | 12/2014 |

(Continued)

OTHER PUBLICATIONS

Pan, GuoShun et al.—"Preparation of silane modified SiO2 abrasive particles and their Chemical Mechanical Polishing (CMP) performances," Wear 273 (2011), pp. 100-104.

(Continued)

*Primary Examiner* — Dung Van Nguyen
(74) *Attorney, Agent, or Firm* — Patterson + Sheridan LLP

(57) ABSTRACT

Embodiments of the present disclosure provide for polishing pads that include at least one endpoint detection (EPD) window disposed through the polishing pad material, and methods of forming thereof. In one embodiment a method of forming a polishing pad includes forming a first layer of the polishing pad by dispensing a first precursor composition and a window precursor composition, the first layer comprising at least portions of each of a first polishing pad element and a window feature, and partially curing the (Continued)

dispensed first precursor composition and the dispensed window precursor composition disposed within the first layer.

20 Claims, 12 Drawing Sheets

(56) References Cited

U.S. PATENT DOCUMENTS 4,844,144 A 7/1989 Murphy et al.
4,942,001 A 7/1990 Murphy et al.
5,096,530 A 3/1992 Cohen
5,120,476 A 6/1992 Scholz
5,121,329 A 6/1992 Crump
5,212,910 A 5/1993 Breivogel et al.
5,387,380 A 2/1995 Cima et al.
5,533,923 A 7/1996 Shamouilian et al.
5,605,760 A 2/1997 Roberts
5,626,919 A 5/1997 Chapman et al.
5,738,574 A 4/1998 Tolles et al.
5,876,490 A 3/1999 Ronay
5,900,164 A 5/1999 Budinger et al.
5,921,855 A 7/1999 Osterheld et al.
5,932,290 A 8/1999 Lombardi et al.
5,940,674 A 8/1999 Sachs et al.
5,984,769 A 11/1999 Bennett et al.
6,022,264 A 2/2000 Cook et al.
6,029,096 A 2/2000 Manners et al.
6,036,579 A 3/2000 Cook et al.
6,095,902 A 8/2000 Reinhardt
6,122,564 A 9/2000 Koch et al.
6,210,254 B1 4/2001 Cook et al.
6,241,596 B1 6/2001 Osterheld et al.
6,273,806 B1 8/2001 Bennett et al.
6,328,634 B1 12/2001 Shen et al.
6,423,255 B1 7/2002 Hoechsmann et al.
6,454,634 B1 9/2002 James et al.
6,488,570 B1 12/2002 James et al.
6,500,053 B2 12/2002 James et al.
6,520,847 B2 2/2003 Osterheld et al.
6,569,373 B2 5/2003 Napadensky
6,582,283 B2 6/2003 James et al.
6,585,563 B1 7/2003 Redeker et al.
6,641,471 B1 11/2003 Pinheiro et al.
6,645,061 B1 11/2003 Bennett et al.
6,682,402 B1 1/2004 Roberts et al.
6,699,115 B2 3/2004 Osterheld et al.
6,736,709 B1 5/2004 James et al.
6,749,485 B1 6/2004 James et al.
6,796,880 B2 9/2004 Redeker et al.
6,811,937 B2 11/2004 Lawton
6,860,793 B2 3/2005 Budinger et al.
6,860,802 B1 3/2005 Vishwanathan et al.
6,869,350 B2 3/2005 Roberts et al.
6,875,097 B2 4/2005 Grunwald
6,913,517 B2 7/2005 Prasad
6,955,588 B1 10/2005 Anderson, II et al.
6,984,163 B2 1/2006 Roberts
6,991,517 B2 1/2006 Redeker et al.
7,169,030 B1 1/2007 Kulp
7,252,871 B2 8/2007 Crkvenac et al.
7,300,619 B2 11/2007 Napadensky et al.
7,371,160 B1 5/2008 Cruz et al.
7,377,840 B2 5/2008 Deopura et al.
7,425,172 B2 9/2008 Misra et al.
7,438,636 B2 10/2008 Kulp et al.
7,445,847 B2 11/2008 Kulp
7,455,571 B1 11/2008 Kuo et al.
7,497,885 B2 3/2009 Kollodge
7,517,488 B2 4/2009 Saikin
7,530,880 B2 5/2009 Bajaj et al.
7,531,117 B2 5/2009 Ederer et al.
7,537,446 B2 5/2009 James et al.
7,704,122 B2 4/2010 Misra et al.
7,704,125 B2 4/2010 Roy et al.
7,815,778 B2 10/2010 Bajaj
7,846,008 B2 12/2010 Bajaj
8,066,555 B2 11/2011 Bajaj
8,075,745 B2 12/2011 Bajaj
8,083,820 B2 12/2011 Kollodge et al.
8,118,641 B2 2/2012 Kulp et al.
8,142,869 B2 3/2012 Kobayashi et al.
8,177,603 B2 5/2012 Bajaj
8,257,545 B2 9/2012 Loyack et al.
8,260,447 B2 9/2012 Mattes et al.
8,287,793 B2 10/2012 Deopura et al.
8,288,448 B2 10/2012 Kulp
8,292,692 B2 10/2012 Bajaj
8,377,623 B2 2/2013 Fong
8,380,339 B2 2/2013 Misra et al.
8,546,717 B2 10/2013 Stecker
8,598,523 B2 12/2013 Stecker et al.
8,702,479 B2 4/2014 Huang et al.
8,709,114 B2 4/2014 Cantrell et al.
8,715,035 B2 5/2014 Roy et al.
8,784,721 B2 7/2014 Philippi et al.
8,821,214 B2 9/2014 Joseph
8,864,859 B2 10/2014 Roy et al.
8,883,392 B2 11/2014 Napadensky et al.
8,888,480 B2 11/2014 Yoo et al.
8,932,116 B2 1/2015 Deopura et al.
8,986,585 B2 3/2015 Cantrell et al.
9,017,140 B2 4/2015 Allison et al.
9,067,297 B2 6/2015 Allison et al.
9,067,299 B2 6/2015 Bajaj et al.
9,126,304 B2 9/2015 Kimura
9,156,124 B2 10/2015 Allison et al.
9,162,340 B2 10/2015 Joseph et al.
9,259,820 B2 2/2016 Qian et al.
9,259,821 B2 2/2016 Qian et al.
9,278,424 B2 3/2016 Roy et al.
9,296,085 B2 3/2016 Bajaj et al.
9,314,897 B2 4/2016 Qian et al.
9,333,620 B2 5/2016 Qian et al.
9,421,666 B2 * 8/2016 Krishnan ..... B29C 64/112
9,457,520 B2 10/2016 Bajaj et al.
9,630,249 B2 4/2017 Toyserkani et al.
9,744,724 B2 8/2017 Bajaj et al.
9,873,180 B2 * 1/2018 Bajaj ..... B24B 37/22
9,993,907 B2 6/2018 Murugesh et al.
10,086,500 B2 10/2018 Orilall et al.
10,384,330 B2 * 8/2019 Bajaj ..... B24D 18/00
10,821,573 B2 * 11/2020 Bajaj ..... B24D 3/28
10,875,145 B2 * 12/2020 Bajaj ..... B24B 37/22
2001/0008830 A1 7/2001 Tolles et al.
2001/0020448 A1 9/2001 Vaartstra et al.
2001/0046834 A1 11/2001 Ramana et al.
2002/0112632 A1 8/2002 Faibish
2002/0173248 A1 11/2002 Doan et al.
2003/0019570 A1 1/2003 Chen et al.
2003/0056870 A1 3/2003 Comb et al.
2003/0181137 A1 9/2003 Redeker et al.
2004/0033758 A1 2/2004 Wiswesser
2004/0055223 A1 3/2004 Ono et al.
2004/0106367 A1 6/2004 Walker et al.
2004/0133298 A1 7/2004 Toyserkani et al.
2004/0154533 A1 8/2004 Agarwal et al.
2004/0173946 A1 9/2004 Pfeifer et al.
2004/0187714 A1 9/2004 Napadensky et al.
2004/0198185 A1 10/2004 Redeker et al.
2005/0020082 A1 1/2005 Vishwanathan et al.
2005/0110853 A1 5/2005 Gardner et al.
2005/0171224 A1 8/2005 Kulp
2005/0260928 A1 11/2005 Huh et al.
2006/0019587 A1 1/2006 Deopura et al.
2006/0024434 A1 2/2006 Wang et al.
2006/0052040 A1 3/2006 Prasad
2006/0160478 A1 7/2006 Donohue et al.
2006/0192315 A1 8/2006 Farr et al.
2007/0054599 A1 3/2007 Taylor et al.
2007/0093185 A1 4/2007 Naik
2007/0128991 A1 6/2007 Yoon et al.
2007/0212979 A1 9/2007 Preston
2007/0235904 A1 10/2007 Saikin

(56) References Cited

U.S. PATENT DOCUMENTS

| | | | |
|---|---|---|---|
| 2008/0009228 | A1 | 1/2008 | Nagase et al. |
| 2008/0157436 | A1 | 7/2008 | Patel et al. |
| 2008/0207100 | A1 | 8/2008 | Roy et al. |
| 2008/0211141 | A1 | 9/2008 | Deopura et al. |
| 2008/0314878 | A1 | 12/2008 | Cai et al. |
| 2009/0053976 | A1 | 2/2009 | Roy et al. |
| 2009/0093201 | A1 | 4/2009 | Kazuno et al. |
| 2009/0105363 | A1 | 4/2009 | Napadensky |
| 2009/0206065 | A1 | 8/2009 | Kruth et al. |
| 2009/0311955 | A1 | 12/2009 | Kerprich et al. |
| 2009/0321979 | A1 | 12/2009 | Hiraide |
| 2010/0130112 | A1 | 5/2010 | Bajaj |
| 2010/0203815 | A1 | 8/2010 | Bajaj |
| 2010/0323050 | A1 | 12/2010 | Kumagai et al. |
| 2011/0059247 | A1 | 3/2011 | Kuzusako et al. |
| 2011/0077321 | A1 | 3/2011 | Napadensky |
| 2011/0180952 | A1 | 7/2011 | Napadensky |
| 2012/0178845 | A1 | 7/2012 | Napadensky et al. |
| 2012/0302148 | A1 | 11/2012 | Bajaj et al. |
| 2012/0315830 | A1 | 12/2012 | Joseph et al. |
| 2013/0017769 | A1 | 1/2013 | Kimura |
| 2013/0019570 | A1 | 1/2013 | Weible |
| 2013/0055568 | A1 | 3/2013 | Dusel et al. |
| 2013/0059509 | A1 | 3/2013 | Deopura et al. |
| 2013/0172509 | A1 | 7/2013 | Pawloski et al. |
| 2013/0231032 | A1 | 9/2013 | Swedek et al. |
| 2013/0247477 | A1 | 9/2013 | Cantrell et al. |
| 2013/0283700 | A1 | 10/2013 | Bajaj et al. |
| 2013/0309951 | A1 | 11/2013 | Benvegnu et al. |
| 2013/0316081 | A1 | 11/2013 | Kovalcik et al. |
| 2013/0328228 | A1 | 12/2013 | Pettis et al. |
| 2014/0048970 | A1 | 2/2014 | Batchelder et al. |
| 2014/0117575 | A1 | 5/2014 | Kemperle et al. |
| 2014/0163717 | A1 | 6/2014 | Das et al. |
| 2014/0206268 | A1 | 7/2014 | Lefevre et al. |
| 2014/0239527 | A1 | 8/2014 | Lee |
| 2014/0324206 | A1 | 10/2014 | Napadensky |
| 2015/0024233 | A1 | 1/2015 | Gunther |
| 2015/0031781 | A1 | 1/2015 | Landers et al. |
| 2015/0037601 | A1 | 2/2015 | Blackmore |
| 2015/0038066 | A1 | 2/2015 | Huang et al. |
| 2015/0045928 | A1 | 2/2015 | Perez et al. |
| 2015/0056421 | A1 | 2/2015 | Yudovin-Farber et al. |
| 2015/0061170 | A1 | 3/2015 | Engel et al. |
| 2015/0065020 | A1 | 3/2015 | Roy et al. |
| 2015/0084238 | A1 | 3/2015 | Bonassar et al. |
| 2015/0093977 | A1 | 4/2015 | Deopura et al. |
| 2015/0115490 | A1 | 4/2015 | Reinarz |
| 2015/0123298 | A1 | 5/2015 | Napadensky |
| 2015/0126099 | A1 | 5/2015 | Krishnan et al. |
| 2015/0129798 | A1 | 5/2015 | Napadensky |
| 2015/0174826 | A1* | 6/2015 | Murugesh ..... B24B 37/24 264/425 |
| 2016/0052103 | A1 | 2/2016 | Qian et al. |
| 2016/0107287 | A1 | 4/2016 | Bajaj et al. |
| 2016/0107288 | A1 | 4/2016 | Orilall et al. |
| 2016/0107381 | A1 | 4/2016 | Krishnan et al. |
| 2016/0114458 | A1 | 4/2016 | Bajaj et al. |
| 2016/0136787 | A1 | 5/2016 | Bajaj et al. |
| 2016/0176021 | A1 | 6/2016 | Orilall et al. |
| 2016/0221145 | A1 | 8/2016 | Huang et al. |
| 2016/0229023 | A1 | 8/2016 | Lugg et al. |
| 2016/0279757 | A1 | 9/2016 | Qian et al. |
| 2016/0354901 | A1 | 12/2016 | Krishnan et al. |
| 2017/0100817 | A1 | 4/2017 | Ganapathiappan et al. |
| 2017/0120416 | A1 | 5/2017 | Chockalingam et al. |
| 2017/0151648 | A1 | 6/2017 | Huang et al. |
| 2017/0203406 | A1 | 7/2017 | Ganapathiappan et al. |
| 2017/0203408 | A1 | 7/2017 | Ganapathiappan et al. |
| 2017/0203409 | A1 | 7/2017 | Lefevre et al. |
| 2017/0259499 | A1 | 9/2017 | Ng et al. |
| 2017/0274498 | A1 | 9/2017 | Oh et al. |
| 2018/0236632 | A1 | 8/2018 | Murugesh et al. |

FOREIGN PATENT DOCUMENTS

| | | | |
|---|---|---|---|
| CN | 104400998 | A | 3/2015 |
| CN | 104607639 | A | 5/2015 |
| EP | 2025458 | A2 | 2/2009 |
| EP | 2025459 | A2 | 2/2009 |
| EP | 2277686 | A2 | 1/2011 |
| EP | 2431157 | A1 | 3/2012 |
| EP | 2463082 | A1 | 6/2012 |
| JP | 09076353 | A | 3/1997 |
| JP | 11-254542 | A | 9/1999 |
| JP | 11-347761 | A | 12/1999 |
| JP | 2001507997 | A | 6/2001 |
| JP | 2002028849 | A | 1/2002 |
| JP | 2004243518 | A | 9/2004 |
| JP | 3801100 | B2 | 7/2006 |
| JP | 2007281435 | A | 10/2007 |
| JP | 2008207323 | A | 9/2008 |
| JP | 2009-101487 | A | 5/2009 |
| KR | 100303672 | B1 | 11/2001 |
| KR | 2003-0020658 | A | 3/2003 |
| KR | 2005-0052876 | A | 6/2005 |
| KR | 10-0606476 | B1 | 8/2006 |
| KR | 20070059846 | A | 6/2007 |
| KR | 2008-0038607 | A | 5/2008 |
| KR | 10-2010-0003251 | A | 1/2010 |
| KR | 1020130138841 | | 12/2013 |
| KR | 10-2015-0047628 | A | 5/2015 |
| WO | 9830356 | A1 | 7/1998 |
| WO | 03089702 | A1 | 10/2003 |
| WO | 2009158665 | A1 | 12/2009 |
| WO | 2011082155 | A2 | 7/2011 |
| WO | 2011088057 | A1 | 7/2011 |
| WO | 2014/095200 | A1 | 6/2014 |
| WO | 2015040433 | A2 | 3/2015 |
| WO | 2015055550 | A1 | 4/2015 |
| WO | 2015111366 | A1 | 7/2015 |
| WO | 2015118552 | A1 | 8/2015 |
| WO | 2015120430 | A1 | 8/2015 |
| WO | 20150161210 | A1 | 10/2015 |
| WO | 2016140968 | A1 | 9/2016 |

OTHER PUBLICATIONS

Plastics in Action; 3-D Printing Speeds Prototype Development dated May/Jun. 1998; 2 total pages.

Wikipedia [online]; "3D Printing," as edited on Jul. 24, 2017 [retrieved on Nov. 9, 2018]; retrieved from theI nternet: https://en.wikipedia.org/w/index.php?title=3D_printing&oldid=792037395, 14 pages.

3D Printing:The Next Industrial Revolution: Christopher Barnatt Publisher: CreateSpace Independent Publishing Platform (May 4, 2013) Language: English ISBN-10: 148418176X ISBN-13: 978-1484181768.

C. Wong. "Damping Associated with Incipient Melting in Aluminum-Indium Alloys", David Taylor Research Center—SME 89-99. Jan. 1990.

Tammy Hickey et al. "Internal Friction and Modules Studies on Austempered Ductile Iron", Technical Report ARCCB-TR-98001. Jan. 1996. 24 pages.

Rodel. Rodel IC1000 CMP Pad. 1999. 2 pages.

Byoung-Ho Kwon et al. "Dishing and Ersosion in STI CMP". System IC R&D Center, Hyundai Electronics Industries Co. Ltd. 1999 IEEE. 3 pages.

S. Raghavan et al. "Chemical Mechanical Planariarization in Integrated Circuit Device Manufacturing". vol. 98-7. 1998. 19 pages.

Rajeev Bajaj et al. "Effect of Polishing Pad Material Properties on Chemical Mechanical Polishing (CMP) Processes". 1994. 8 pages.

Rodel. Rodel IC1010. 1998. 2 pages.

Peter Freeman et al. "A Study of the Variation of Physical Properties in Random Lots of Urethane Polishing Pads for CMP". A Rodel Publication. vol. 2, Issue 6. Jun. 1996. 8 Pages.

John J. Aklonis et al. "Introduction to Polymer Viscoelasticity". Second Edition. 1983. 6 pages.

Weidan Li et al. "The Effect of the Polishing Pad Treatments on the Chemical-Mechanical Polishing of SiO2 Films", Thin Solid Films 270 (1995). 6 pages.

(56) References Cited

OTHER PUBLICATIONS

Peter Krober et al. "Reactive Inkjet Printing of Polyurethanes", www.rsc.org/materials. Journal of Materials Chemistry. Jan. 6, 2009.
Yu-Lim Jun et al. "Slicing Bitmap Generation and Patterning Technique a SFF System Using UV-Resin", International conference on Control, Automation and Systems 2007. 5 Pages.
H. Yang. "High Viscosity Jetting System for 3D Reactive Inkjet Printing", Additive Manufacturing and 3D Printing Group, University of Nottingham. 9 pages.
I Hermant et al. "A Comparative Study of Polyurethane-Poly(Methyl Methacrylate) Interpenetrating and Semi-1 Interprenetrating Polymer Networks", vol. 20, No. 1 pp. 85-89, 1984.
Lee M. Cook. "CMP Consumables II: Pad" Chapter 6. Semiconductors and Semimetals, vol. 63. Published 1999. chemical Mechanical Polishing in Silicon Processing. ISBN: 978-0-12-752172-5.
Antje M.J. Van Den Berg, "Inkjet Printing of Polyurethane Colloidal Suspensions", www.rsc.org/softmatter. Jul. 13, 2006.
The Dow Chemical Company—"Specialty Elastomers for Automotive TPO Compounds" brochure, Nov. 2006, 8 pages.
The Dow Chemical Company—"Dow VLDPE DFDB-1085 NT, Very Low Density Polyethylene Resin" Technical Data, UL Prospector, Oct. 2003, 2 pages.
Lubrizol Advanced Materials, Inc.—"Lubrizol Engineered Polymers, Estane 58144 TPU" Technical Data, Feb. 2014, 2 pages.
Sekisui Voltek, LLC—"Volara Type EO" Technical Data, Jan. 2010, 2 pages.
Rogers Corporation, High Performance Foams Division, PORON Microcellular Urethanes—Product Availability Booklet, May 1, 2015, 11 pages.
Epoxy Technology Inc.—"Tech Tip 23: Tg—Glass Transition Temperature for Epoxies" brochure, date unknown, 2 pages.
PCT International Search Report and Written Opinion dated Dec. 11, 2018, for International Application No. PCT/US2018/045122.

* cited by examiner

POLISHING PAD WITH WINDOW AND MANUFACTURING METHODS THEREOF

CROSS-REFERENCE TO RELATED APPLICATIONS

This application claims priority to U.S. Provisional Application Ser. No. 62/541,497, filed on Aug. 4, 2017, and U.S. Provisional Application Ser. No. 62/562,237, filed on Sep. 22, 2017, both of which are herein incorporated by reference in their entireties.

BACKGROUND

Field

Embodiments of the present disclosure generally relate to a polishing pad, and methods of forming a polishing pad, and more particularly, to a polishing pad used for polishing a substrate in an electronic device fabrication process.

Description of the Related Art

Chemical mechanical polishing (CMP) is commonly used in the manufacture of high-density integrated circuits to planarize or polish a layer of material deposited on a substrate. Often, the material layer to be planarized is contacted to polishing pad mounted on a polishing platen. The polishing pad and/or the substrate (and thus the material layer surface on the substrate) are moved relative to one another in the presence of a polishing fluid and abrasive particles. Two common applications of CMP are planarization of a bulk film, for example pre-metal dielectric (PMD) or interlayer dielectric (ILD) polishing, where underlying features create recesses and protrusions in the layer surface, and shallow trench isolation (STI) and interlayer metal interconnect polishing. In STI and interlayer metal interconnect CMP, polishing is used to remove a via, contact or trench fill material from the exposed surface (field) of the layer having the feature extending thereinto.

Endpoint detection (EPD) methods are commonly used in CMP processes to determine when a bulk film has been polished to a desired thickness or when via, contact or trench fill material has been removed from the field (upper surface) of a layer. One EPD method includes directing a light towards the substrate, detecting light reflected therefrom, and determining a thickness of a transparent bulk film on the substrate surface using an interferometer. Another EPD method includes monitoring for changes in the reflectance of the substrate to determine the removal of a reflective material from the field of the layer surface. Typically, the light is directed through an opening in the polishing platen and the polishing pad disposed thereon. The polishing pad includes a transparent window that is positioned adjacent to the opening in the polishing platen which allows the light to pass therethrough. The window is generally formed of a polyurethane material that is adhered to the polishing pad material therearound using an adhesive or that is molded into the polishing pad during the manufacturing thereof. Typically, the material properties of the window are limited by the selection of commercially available polyurethane sheets and or molding materials that are not optimized for specific CMP processes or polishing pad materials.

Accordingly, there is a need in the art for methods of customizing and/or tuning the material properties of polishing pad EPD windows and for polishing pads formed using those methods.

SUMMARY

Embodiments herein generally relate to a polishing pad having an endpoint detection (EPD) window feature disposed therethrough, and methods of forming the polishing pad and the window feature.

In one embodiment, a method of forming a polishing pad is provided. The method includes forming a first layer of the polishing pad by dispensing a first precursor composition and a window precursor composition. The first layer herein comprises at least portions of each of a first polishing pad element and a window feature. The method further includes partially curing the dispensed first precursor composition and the dispensed window precursor composition to form an at least partially cured first layer. In some embodiments, the method further includes forming a second layer on the at least partially cured first layer by dispensing the window precursor composition and a second precursor composition. The second layer herein comprises at least portions of each the window feature, and one or more second polishing pad elements. In some embodiments, the method further includes partially curing the dispensed window precursor composition and the second precursor composition disposed within the second layer. In some embodiments, forming the first layer comprises forming a plurality of first sub-layers and forming the second layer comprises forming a plurality of second sub-layers. Forming each of the sub-layers herein includes dispensing droplets of one or more precursor compositions and at least partially curing the dispensed droplets before forming a next sub-layer thereon.

In another embodiment, another method of forming a polishing pad is provided. The method includes forming a first layer of the polishing pad by dispensing a first precursor composition, where the first layer comprises at least a portion a sub-polishing element having an opening disposed therethrough, and partially curing the dispensed first precursor composition with the first layer. The method further includes forming a second layer on the at least partially cured first layer by dispensing a second precursor composition, where the second layer comprises at least portions one or more polishing elements, and where the opening is further disposed through the second layer. The method further includes partially curing the dispensed second precursor composition within the second layer. The method further includes forming a window in the opening by dispensing a window precursor composition thereinto and curing the window precursor composition. In some embodiments, forming the first layer comprises forming a plurality of first sub-layers and forming the second layer comprises forming a plurality of second sub-layers. Forming each of the sub-layers herein includes dispensing droplets of one or more precursor compositions and at least partially curing the dispensed droplets before forming a next sub-layer thereon.

In another embodiment, a polishing article is provided. The polishing article comprises a sub-polishing element, a plurality of polishing elements extending from the sub-polishing element, and a window feature disposed through the sub polishing element and the plurality of polishing elements. In this embodiment, the sub-polishing element, the plurality of polishing elements, and the window feature are chemically bonded at the interfaces thereof.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure provide for polishing pads that include at least one endpoint detection (EPD) window disposed through the polishing pad material, and methods of forming them. The polishing pads are formed using an additive manufacturing process, such as a two-dimensional (2D) or three-dimensional (3D) inkjet printing process. Additive manufacturing processes, such as the three-dimensional printing ("3D printing") process described herein, enable the formation of polishing pads with discrete regions, elements, or features having unique properties and attributes. Generally, the pad material is one or more polymers, and the polymers of the regions, elements, and/or features form chemical bonds, for example covalent bonds or ionic bonds, with the polymers of adjacent regions, elements, and/or features at the interfaces thereof. The chemical bonds typically comprise the reaction product of one or more curable resin precursors used to form adjacent regions, elements, and/or features. In some embodiments, the regions, elements, and/or features form a continuous polymer phase while maintaining the distinct material properties associated with each region, element and/or feature.

Figure 1:
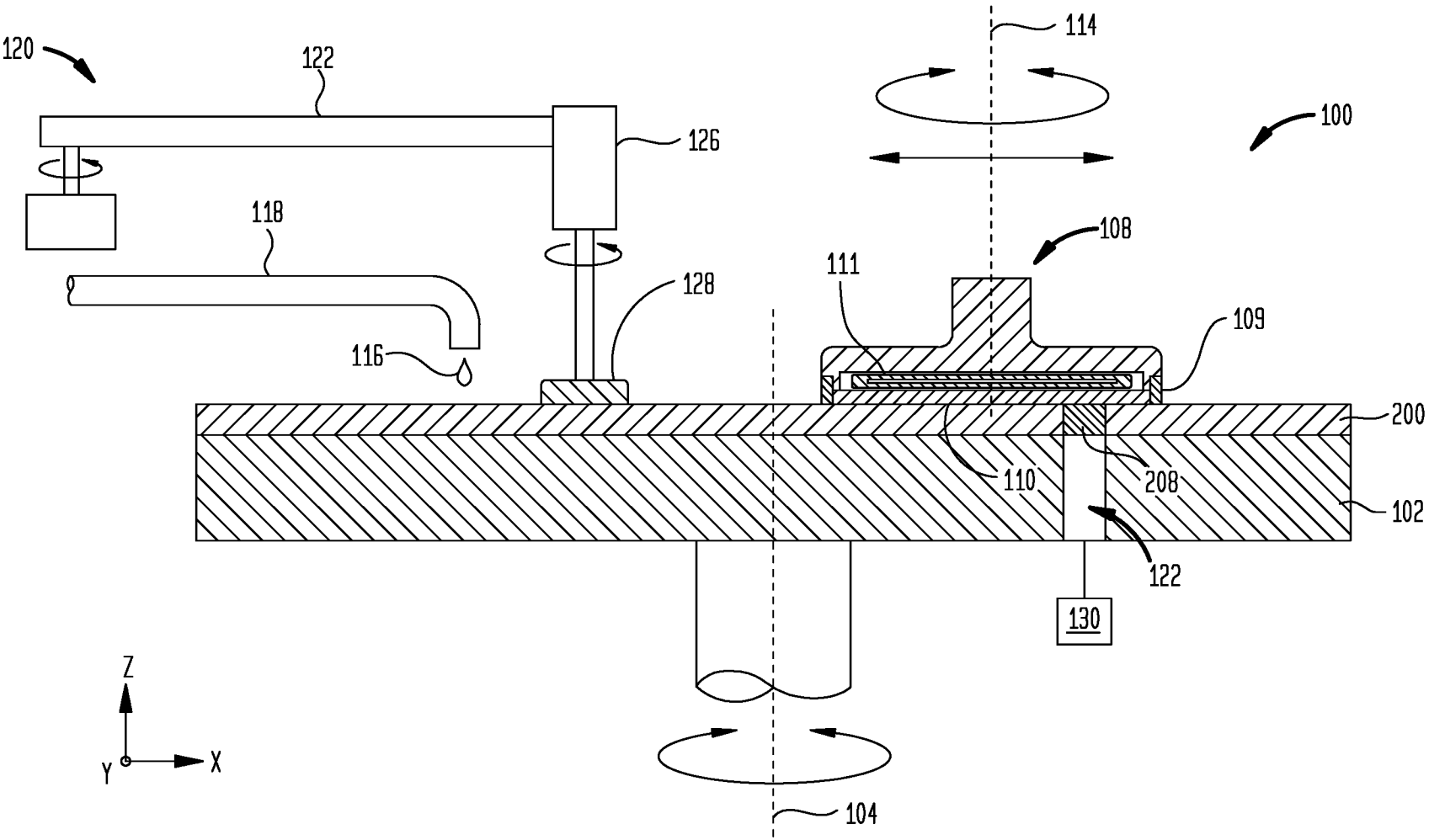
FIG. 1 is a schematic sectional view of a polishing system using a polishing pad formed according to embodiments described herein.

FIG. 1 is a schematic sectional view of an example of a polishing system 100 using a polishing pad 200 formed according to the embodiments described herein. Typically, the polishing pad 200 is secured to a platen 102 of the polishing system 100 using an adhesive, such as a pressure sensitive adhesive (PSA) layer (not shown), disposed between the polishing pad 200 and the platen 102. A substrate carrier 108, facing the platen 102 and the polishing pad 200 mounted thereon, includes a flexible diaphragm 111 configured to impose different pressures against different regions of a substrate 110 while urging the to be polished surface of the substrate 110 against the polishing surface of the polishing pad 200. The substrate carrier 108 includes a carrier ring 109 surrounding the substrate 110. During polishing, a downforce on the carrier ring 109 urges the carrier ring 109 against the polishing pad 200 to prevent the substrate 110 from slipping from the substrate carrier 108. The substrate carrier 108 rotates about a carrier axis 114 while the flexible diaphragm 111 urges the to be polished surface of the substrate 110 against the polishing surface of the polishing pad 200. The platen 102 rotates about a platen axis 104 in an opposite rotational direction from the rotation direction of the substrate carrier 108 while the substrate carrier 108 sweeps back and forth from an inner diameter of the platen 102 to an outer diameter of the platen 102 to, in part, reduce uneven wear of the polishing pad 200. Herein, the platen 102 and the polishing pad 200 have a surface area that is greater than the to be polished surface area of the substrate 110, however, in some polishing systems, the polishing pad 200 has a surface area that is less than the to be polished surface area of the substrate 110. An endpoint detection (EPD) system 130 directs light towards the substrate 110 through a platen opening 122 and further through an optically transparent window feature 208 of the polishing pad 200 disposed over the platen opening 122.

During polishing, a fluid 116 is introduced to the polishing pad 200 through a fluid dispenser 118 positioned over the platen 102. Typically, the fluid 116 is a polishing fluid (including water as a polishing fluid or a part of the polishing material), a polishing slurry, a cleaning fluid, or a combination thereof. In some embodiments, the fluid 116 is a polishing fluid comprising a pH adjuster and/or chemically active components, such as an oxidizing agent, to enable chemical mechanical polishing of the material surface of the substrate 110 in conjunction with the abrasives of the polishing pad 200.

Figure 2A:
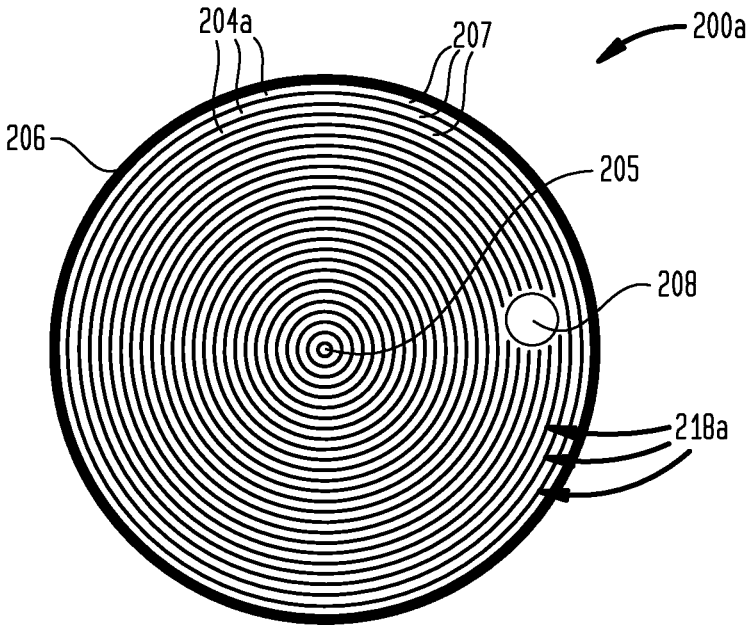
FIG. 2A is a schematic top down view of a polishing pad formed according to methods set forth herein, according to one embodiment.
Figure 2B:
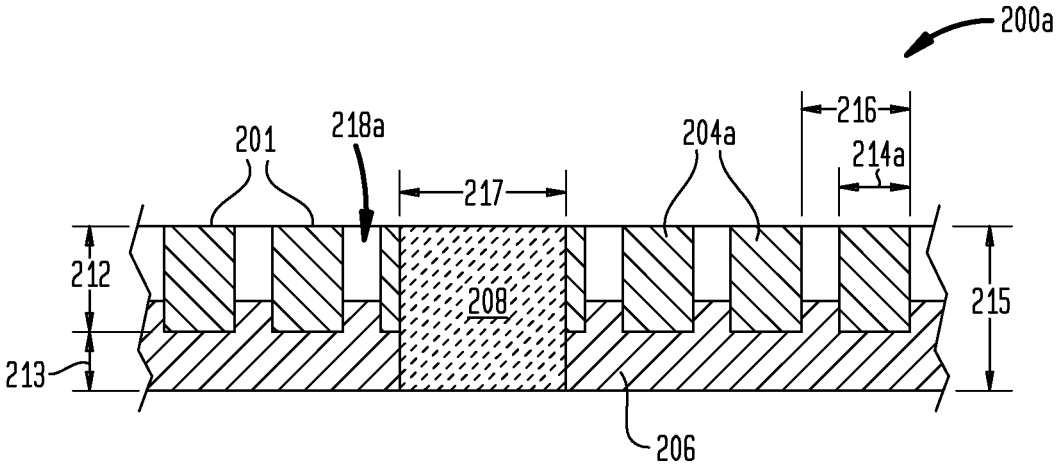
FIG. 2B is a schematic cross sectional view of a portion of the polishing pad shown in FIG. 2A.
Figure 2C:
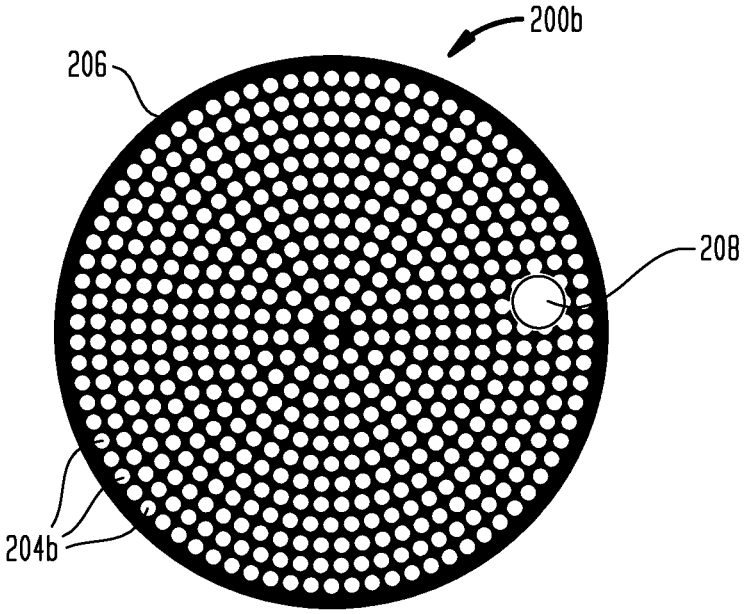
FIG. 2C is a schematic top down view polishing pad formed according to methods set forth herein, according to another embodiment.
Figure 2D:
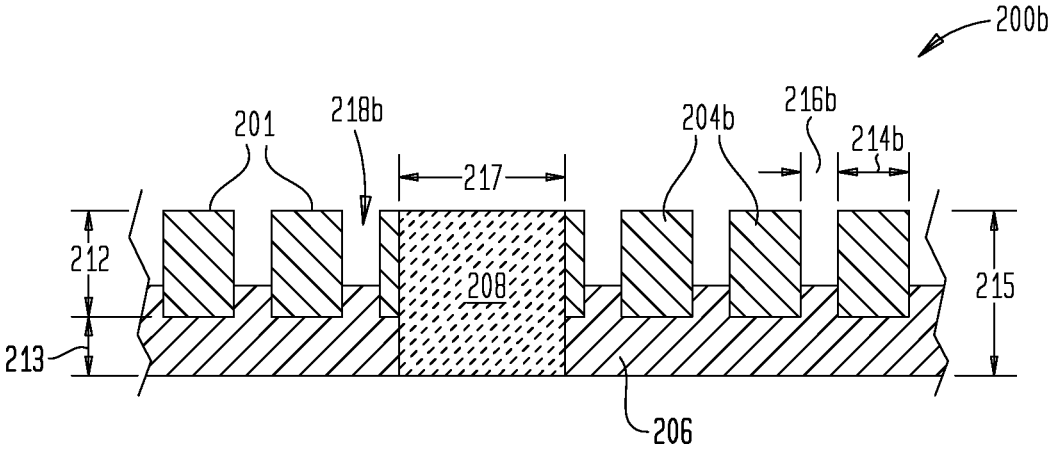
FIG. 2D is a schematic cross sectional view of a portion of the polishing pad shown in FIG. 2C.

FIGS. 2A and 2C are schematic top down views of polishing pads formed according to embodiments described herein. FIGS. 2B and 2D are schematic cross sectional views of portions of the polishing pads shown in FIGS. 2A and 2C respectively. The polishing pads 200*a*, 200*b* can be used as the polishing pad 200 in the polishing system 100 of FIG. 1. In FIGS. 2A-2B, the polishing pad 200*a* comprises a plurality of polishing elements 204*a*, a sub-polishing element 206, and a window feature 208. The plurality of polishing elements 204*a* are disposed on and/or within the sub-polishing element 206 and extend from a surface thereof. The window feature 208 extends through the polishing pad 200*a* and is located at a pad location between the center of the polishing pad 200*a* and an outer edge thereof. Herein, one or more of the plurality of polishing elements 204*a* have a first thickness 212, the sub-polishing element 206 extends beneath the polishing element 204*a* at a second thickness 213, and the polishing pad 200*a* has an overall third thickness 215.

As shown in FIG. 2A, this aspect of the pad 200*a* includes a plurality of polishing elements 204*a* including an upwardly extending post 205 disposed in the center of the polishing pad 200*a* and a plurality of upwardly extending concentric rings 207 disposed about the post 205 and spaced radially outwardly therefrom. The plurality of polishing elements 204*a* and the sub-polishing element 206 resultantly define a plurality of circumferential channels 218*a* disposed in the polishing pad 200*a* between each of the polishing elements 204*a* and between a plane of the polishing surface 201 of the polishing pad 200*a* and a surface of the sub-polishing element 206. The plurality of channels 218 enable the distribution of polishing fluid across the polishing pad 200*a* and to the interface region between the polishing pad 200*a* and the to be polished surface of a substrate 110. In other embodiments, the patterns of the polishing elements 204*a* are rectangular, spiral, fractal, random, another pattern, or combinations thereof. Herein, the width 214*a* of the polishing element(s) 204*a* in the radial direction of the pad 200*a* is between about 250 microns and about 5 millimeters, such as between about 250 microns and about 2 millimeters and a pitch 216 of the polishing element(s) 204*a* is between about 0.5 millimeters and about 5 millimeters. In some embodiments, the width 214*a* and/or the pitch 216 in the radial direction varies across the radius of the polishing pad 200*a*, 200*b* to define zones of pad material properties and/or abrasive particle concentration. Additionally, the center of the series of polishing elements 204*a* may be offset from the center of the sub-polishing element 206.

In FIGS. 2C-2D, the polishing elements 204*b* of pad 200*b* are shown as circular cylindrical columns extending from the sub-polishing element 206. In other embodiments, the polishing elements 204*b* are of any suitable cross-sectional shape, for example individual columns with toroidal, partial toroidal (e.g., arc), oval, square, rectangular, triangular, polygonal, irregular shapes, or combinations thereof. The polishing elements 204*b* and sub-polishing element 206 define flow regions 218*b* between the polishing elements 204*b*. In some embodiments, the shapes and widths 214 of the polishing elements 204*b*, and the distances 216*b* therebetween, are varied across the polishing pad 200*b* to tune the hardness, mechanical strength, fluid transport characteristics, or other desirable properties of the complete polishing pad 200*b*. The width 214*b* of the polishing element(s) 204*b* is between about 250 microns and about 5 millimeters, such as between about 250 microns and about 2 millimeters, typically the polishing elements are spaced apart from each other by a distance 216*b* between about 0.5 millimeters and about 5 millimeters.

As illustrated in FIGS. 2B and 2D, the polishing elements 204*a*, 204*b* are supported by a portion of the sub-polishing element 206 (e.g., portion within the first thickness 212). Therefore, when a load is applied to the polishing surface 201 of the polishing pads 200*a*, 200*b* (e.g., top surface) by a substrate during processing, the load will be transmitted through the polishing elements 204*a*, 204*b* and a portion of the sub-polishing element 206 located therebeneath.

Herein, the polishing elements 204*a*, 204*b* and the sub-polishing element 206 each comprise a continuous polymer phase formed from of at least one of oligomeric and/or polymeric segments, compounds, or materials selected from the group consisting of: polyamides, polycarbonates, polyesters, polyether ketones, polyethers, polyoxymethylenes, polyether sulfone, polyetherimides, polyimides, polyolefins, polysiloxanes, polysulfones, polyphenylenes, polyphenylene sulfides, polyurethanes, polystyrene, polyacrylonitriles, polyacrylates, polymethylmethacrylates, polyurethane acrylates, polyester acrylates, polyether acrylates, epoxy acrylates, polycarbonates, polyesters, melamines, polysulfones, polyvinyl materials, acrylonitrile butadiene styrene (ABS), halogenated polymers, block copolymers and random copolymers thereof, and combinations thereof.

In some embodiments, the materials used to form portions of the polishing pads 200*a*, 200*b*, such as the polishing elements 204*a*, 204*b* and the sub-polishing element 206 will include the reaction product of at least one ink-jettable pre-polymer composition that is a mixture of functional polymers, functional oligomers, reactive diluents, and/or curing agents to achieve the desired properties of a polishing pad 200*a*, 200*b*. In some embodiments, interfaces between, and coupling between, the polishing elements 204*a*, 204*b* and the sub-polishing element 206 include the reaction product of pre-polymer compositions, such as a first curable resin precursor composition, used to form the sub-polishing element 206 and a second curable resin precursor composition, used to form the polishing elements 204*a*, 204*b*. In general, the pre-polymer compositions are exposed to electromagnetic radiation, which may include ultraviolet radiation (UV), gamma radiation, X-ray radiation, visible radiation, IR radiation, and microwave radiation and also accelerated electrons and ion beams to initiate the polymerization reactions which form the continuous polymer phases of the polishing elements 204*a*, 204*b* and the sub-polishing element 206. The method(s) of polymerization (cure), or the use of additives to aid the polymerization of the polishing elements 204*a*, 204*b* and the sub-polishing element 206, such as sensitizers, initiators, and/or curing agents, such as through cure agents or oxygen inhibitors, are not restricted for the purposes hereof.

The window feature 208 herein comprises a continuous polymer phase formed from of at least one of oligomeric and/or polymeric segments, compounds, or materials selected from the group consisting of: polyacrylates, polymethacrylates, polyurethane acrylates, polyester acrylates, polyether acrylates, epoxy acrylates, polyacrylonitriles, block copolymers thereof, and random copolymers thereof.

Typically, the window feature 208 is formed of a material that includes the reaction product of at least one ink-jettable precursor composition. The ink-jettable precursor composition is a mixture of one or more of acrylate based non-yellowing monomers, acrylate based non-yellowing oligomers, photoinitiators, and/or thermal initiators, where the mixture is formulated to achieve the desired properties of the window feature 208. In some embodiments, the window feature 208 is formed of a material that includes the reaction product of one or more of acrylates, methacrylates, epoxides, oxetanes, polyols, photoinitiators, amines, thermal initiators, and/or photosensitizers.

In one embodiment, the sub-polishing element 206 and the plurality of polishing elements 204*a,b* are formed from a sequential deposition and post deposition process and comprise the reaction product of at least one radiation curable resin precursor composition, wherein the radiation curable precursor compositions contain functional polymers, functional oligomers, monomers, and/or reactive diluents that have unsaturated chemical moieties or groups, including but not restricted to: vinyl groups, acrylic groups, methacrylic groups, allyl groups, and acetylene groups.

Typical material composition properties that may be selected using the methods and material compositions described herein include storage modulus E', loss modulus E", hardness, tan δ, yield strength, ultimate tensile strength, elongation, thermal conductivity, zeta potential, mass density, surface tension, Poison's ratio, fracture toughness, surface roughness ($R_a$), glass transition temperature (Tg) and other related properties. For example, storage modulus E' influences polishing results such as the removal rate from, and the resulting planarity of, the material layer surface of a substrate. In some embodiments, it is desirable for the window material to have a similar storage modulus as the surrounding polishing elements so that the window material wears at a similar rate and does not extend above or below the surface or the polishing pad over the lifetime thereof. Typically, polishing pad material compositions having a medium or high storage modulus E' provide a higher removal rate for dielectric films used for PMD, ILD, and STI, and cause less undesirable dishing of the upper surface of the film material in recessed features such as trenches, contacts, and lines. Polishing pad material compositions having a low storage modulus E' generally provide more stable removal rates over the lifetime of the polishing pad, cause less undesirable erosion of a planer surface in areas with high feature density, and cause reduced micro scratching of the material surface. Characterizations as a low, medium, or high storage modulus E' pad material composition at temperatures of 30° C. (E'30) and 90° C. (E'90) are summarized in Table 1.

TABLE 1

| | Low Storage Modulus Compositions | Medium Modulus Compositions | High Modulus Compositions |
|---|---|---|---|
| E'30 | 5 MPa-100 MPa | 100 MPa-500 MPa | 500 MPa-3000 MPa |
| E'90 | <17 MPa | <83 MPa | <500 MPa |

In embodiments herein, the window feature 208 is formed of materials having an E'30 between about 2 MPa and about 1500 MPa and an E'90 between about 2 MPa and about 500 MPa, such as between about 2 MPa, and about 100 MPa. The polishing elements 204*a*, 204*b* and the window feature 208 are typically formed from materials having a medium or high (hard) storage modulus E'. Forming the window feature 208 from materials having the same or similar storage modulus E' as the surrounding polishing elements 204*a*, 204*b* provides for similar wear rates between the window feature 208 and the polishing elements 204*a*, 204*b* so that the window feature 208 remains desirably planer with the surrounding polishing pad material during the lifetime of the polishing pad. Typically, the sub-polishing element 206 is formed from materials different from the materials forming the polishing elements 204*a*, 204*b*, such as materials having a low (soft) or moderate storage modulus E'. Typically, the window feature 208 materials formed herein have an ultimate tensile strength of between about 2 MPa and about 100 MPA and between about 8% and about 130% of elongation to break. The window feature 208 materials formed herein typically have a storage modulus recovery of more than about 40%, where storage modulus recovery is a ratio of E'30 in a second cycle to E'30 in a first cycle under dynamic mechanic analysis (DMA) and a hardness under durometer of between about 60A and about 70D.

In FIGS. 2A-2D the window feature 208 has a cylindrical shape, i.e., a circular shape in top-down cross-section or plan view, with a diameter 217 between about 1 mm and about 100 mm. In other embodiments, the window feature 208 has any other top down cross-sectional shape, such as toroidal, partial toroidal (e.g., arc), oval, square, rectangular, triangular, polygonal, irregular shapes, or combinations thereof. In some embodiments, the top-down cross-sectional shape is selected to increase the bonding surface area between the polymer materials forming the polishing elements 204*a*, 204*b* and the sub-polishing element 206 and a window feature formed therewith, such as shown in FIG. 2E.

Figure 2E:
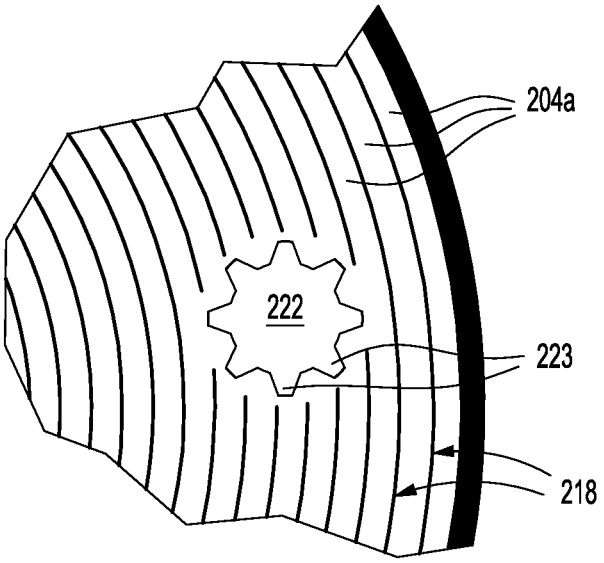
FIG. 2E is a schematic top down view of a portion of a polishing pad formed according to methods set forth herein, according to another embodiment.

FIG. 2E is a schematic plan view of a portion of the polishing pad 200*a* described in FIGS. 2A-2B having a gear shaped window feature 222 in place of the window feature 208. In FIG. 2E the window feature 222 has a top down cross-sectional shape comprising a circular cross-sectional shape with a plurality of fingers 223, i.e., protuberances in the shape of gear teeth shaped, extending radially outward therefrom. Here, the plurality of fingers 223 form an interdigitated structure with the material of the polishing elements 204*a* and sub-polishing element 206 adjacent thereto. The interdigitated structure increases the interfacial surface area between the window feature 222 and the polishing elements 204*a* and sub-polishing element 206, and provides structural elements tending to keep the window feature 222 from rotating or twisting with respect to the polishing elements 204*a* during installation on a polishing tool and/or during a substrate polishing process. The increased interfacial surface area, and thus the increased number of polymeric bonds between the window feature 222 and surrounding polishing pad material, reduces or substantially eliminates undesired process events related to pop-out of the window feature 222 from the polishing pad 200*a* which allows for more aggressive conditioning thereof and/or polishing processes.

Figure 2F:
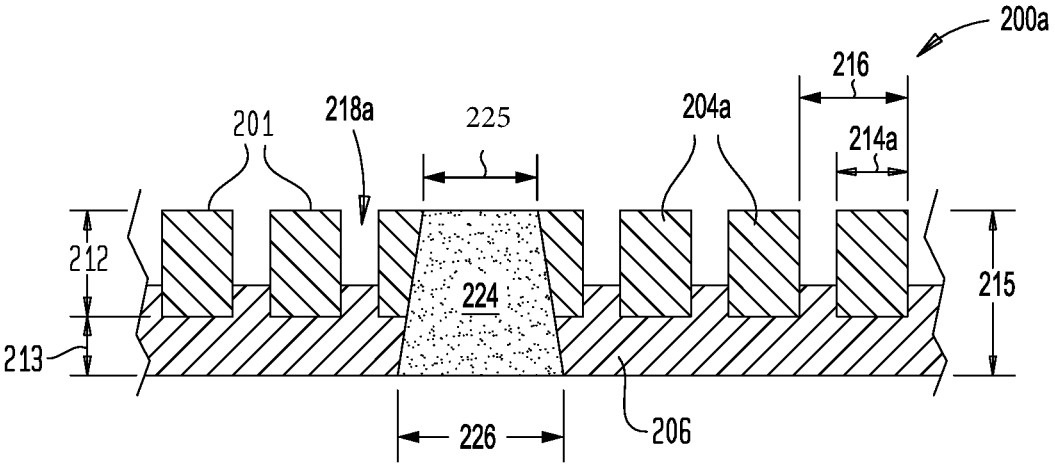
FIG. 2F is a schematic cross-sectional view of a portion of a polishing pad formed according to methods set forth herein, according to another embodiment.

FIG. 2F is a schematic cross-sectional view of the polishing pad 200*a* described in FIGS. 2A-2B having a window feature 224 in place of the window feature 208. Here, the window feature 224 features a trapezoidal cross-sectional shape in the depth direction of the polishing pad 200*a* having a first width 225 measured proximate to the polishing surface of the polishing pad 200*a* and coplanar therewith and a second width 226 measured proximate to the mounting surface (bottom surface), or at least inwardly of the polishing surface side, of the polishing pad 200*a* and parallel to the first width 225. Herein, the mounting surface of the polishing pad is opposite of, and generally parallel to, the polishing surface thereof. Here, the first width 225 is less than the second width 226 which mechanically locks the window feature 224 in the polishing pad 200*a* when the polishing pad 200*a* is mounted on a polishing platen of a polishing system. For example, in some embodiments, the ratio of the first width 225 to second width 226 is between about 0.5:1 and about 0.9:1. In some embodiments, the window feature 224 of formed of and according to any of the respective material compositions or methods set forth for the window feature 208 described throughout the disclosure. Typically, the window feature 224 has any desired top down cross-sectional shape, such as circular, toroidal, partial toroidal (e.g., arc), oval, square, rectangular, triangular, polygonal, irregular shapes, or combinations thereof. In some embodiments, the top-down cross-sectional shape of the window feature 224 forms and interdigitated structure with the polishing pad material, such as shown for the window feature 222 illustrated in FIG. 2E.

Figures 3A, 3B:
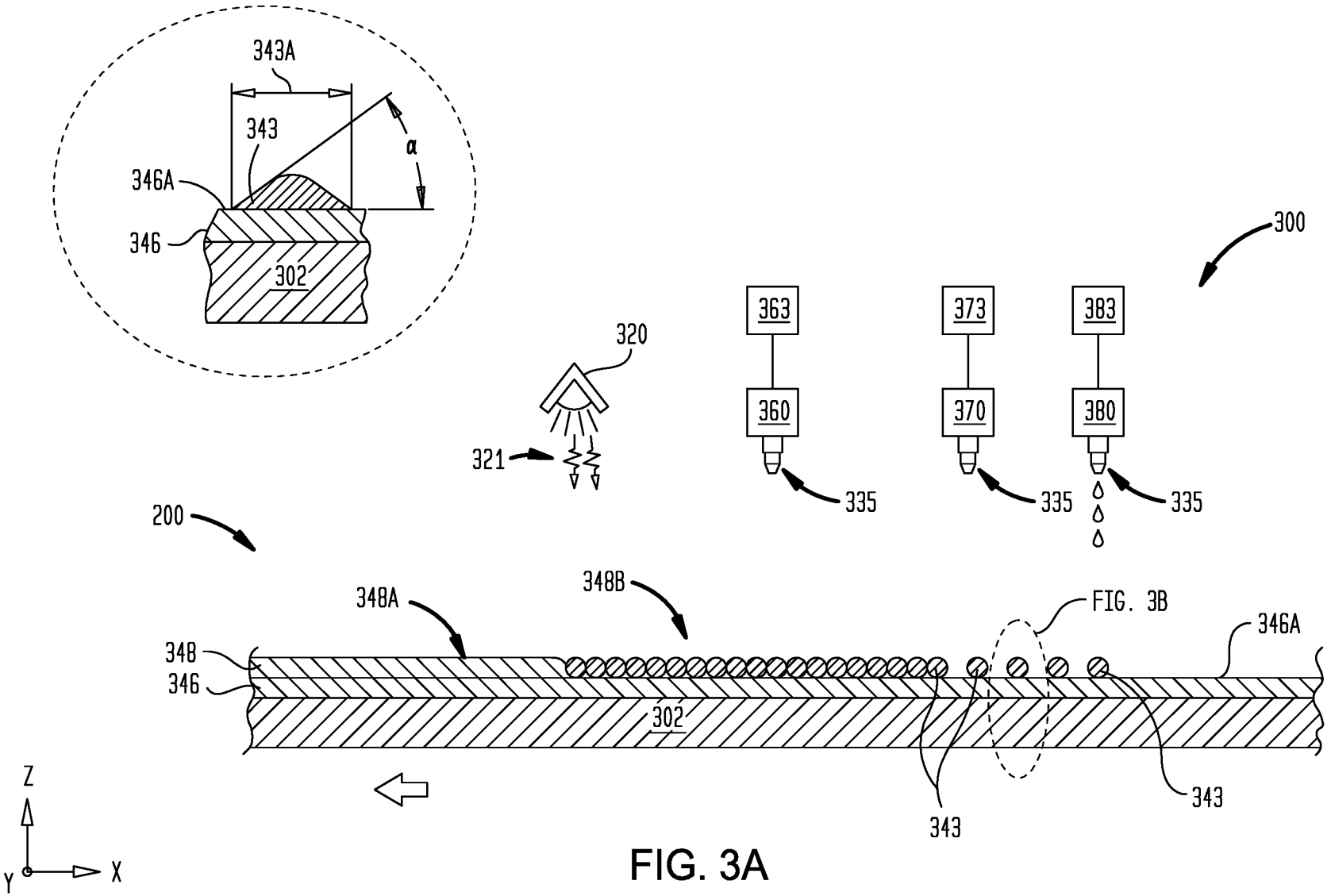
FIG. 3A is a schematic sectional view of an exemplary additive manufacturing system used to form a polishing pad, such as the polishing pads described in FIGS. 2A-2D
FIG. 3B is a close up cross-sectional view of a droplet dispensed onto the surface of the one or more previously formed layers of the window feature formed using the additive manufacturing system described in FIG. 3A.

FIG. 3A is a schematic sectional view of an additive manufacturing system 300 used to form a polishing pad, such as polishing pads 200*a*, 200*b*, according to embodiments disclosed herein. The additive manufacturing system 300 herein includes a first dispensing head 360 for dispensing droplets of a first precursor composition 363, a second dispensing head 370 for dispensing droplets of a second precursor composition 373, and a third dispensing head 380 for dispensing droplets of a window precursor composition 383. Typically, the dispensing heads 360, 370, 380 move independently of each other and independently of a manufacturing support 302 during the printing process to enable the placement of droplets of the precursor compositions 363, 373, and 383 at selected locations on the manufacturing support 302 to form a polishing pad, such as the polishing pads 200*a*, 200*b*. The selected locations are collectively stored as a CAD-compatible printing pattern which is readable by an electronic controller (not shown) that directs the motion of the manufacturing support 302, the motion of the dispensing heads 360, 370, 380 and the delivery of the droplets of the precursor compositions 363, 373, 383 from one or more nozzles 335.

Herein, the first precursor composition 363 is used to form the sub-polishing element 206, the second precursor compositions 373 is used to form the polishing elements 204*a*, 204*b*, and the window precursor composition 383 is used to form the window feature 208 of the polishing pads 200*a*, 200*b* shown in FIGS. 2A-2B, 2C-2D. Typically, the first and second precursor compositions 363 and 373 each comprise a mixture of one or more of functional polymers, functional oligomers, functional monomers, and/or reactive diluents that are at least monofunctional, and undergo polymerization when exposed to free radicals, photoacids, Lewis acids, and/or electromagnetic radiation.

Examples of functional polymers used in the first and/or second precursor compositions 363 and 373 include multifunctional acrylates including di, tri, tetra, and higher functionality acrylates, such as 1,3,5-triacryloylhexahydro-1,3,5-triazine or trimethylolpropane triacrylate.

Examples of functional oligomers used in the first and/or second precursor compositions 363 and 373 include monofunctional and multifunctional oligomers, acrylate oligomers, such as aliphatic urethane acrylate oligomers, aliphatic hexafunctional urethane acrylate oligomers, diacrylate, aliphatic hexafunctional acrylate oligomers, multifunctional urethane acrylate oligomers, aliphatic urethane diacrylate oligomers, aliphatic urethane acrylate oligomers, aliphatic polyester urethane diacrylate blends with aliphatic diacrylate oligomers, or combinations thereof, for example bisphenol-A ethoxylate diacrylate or polybutadiene diacrylate. In one embodiment, the functional oligomer comprises tetrafunctional acrylated polyester oligomer available from Allnex Corp. of Alpharetta, Ga. as EB40® and the functional oligomer comprises an aliphatic polyester based urethane diacrylate oligomer available from Sartomer USA of Exton, Pa. as CN991.

Examples of monomers used in the first and/or second precursor compositions 363 and 373 include both monofunctional monomers and multifunctional monomers. Monofunctional monomers include tetrahydrofurfuryl acrylate (e.g. SR285 from Sartomer®), tetrahydrofurfuryl methacrylate, vinyl caprolactam, isobornyl acrylate, isobornyl methacrylate, 2-phenoxyethyl acrylate, 2-phenoxyethyl methacrylate, 2-(2-ethoxyethoxy)ethyl acrylate, isooctyl acrylate, isodecyl acrylate, isodecyl methacrylate, lauryl acrylate, lauryl methacrylate, stearyl acrylate, stearyl methacrylate, cyclic trimethylolpropane formal acrylate, 2-[[(Butylamino) carbonyl]oxy]ethyl acrylate (e.g. Genomer 1122 from RAHN USA Corporation), 3,3,5-trimethylcyclohexane acrylate, or mono-functional methoxylated PEG (350) acrylate. Multifunctional monomers include diacrylates or dimethacrylates of diols and polyether diols, such as propoxylated neopentyl glycol diacrylate, 1,6-hexanediol diacrylate, 1,6-hexanediol dimethacrylate, 1,3-butylene glycol diacrylate, 1,3-butylene glycol dimethacrylate 1,4-butanediol diacrylate, 1,4-butanediol dimethacrylate, alkoxylated aliphatic diacrylate (e.g., SR9209A from Sartomer®), diethylene glycol diacrylate, diethylene glycol dimethacrylate, dipropylene glycol diacrylate, tripropylene glycol diacrylate, triethylene glycol dimethacrylate, alkoxylated hexanediol diacrylates, or combinations thereof, for example SR562, SR563, SR564 from Sartomer®.

Examples of reactive diluents used in the first and/or second precursor compositions 363 and 373 include monoacrylate, 2-ethylhexyl acrylate, octyldecyl acrylate, cyclic trimethylolpropane formal acrylate, caprolactone acrylate, isobornyl acrylate (IBOA), or alkoxylated lauryl methacrylate.

Examples of photoacids used in the first and/or second precursor compositions 363 and 373 include onium salts such as Omnicat 250, Omnicat 440, and Omnicat 550, manufactured by manufactured by IGM Resins USA Inc. of Charlotte N.C. and compositional equivalents thereof, triphenylsulfonium triflate, and triarylsulfonium salt type photo acid generators such as CPI-2105 available from San-Apro Ltd. of Tokyo, Japan, and compositional equivalents thereof.

In some embodiments, the first and/or second precursor compositions 363 and 373 further comprise one or more photoinitiators. Photoinitiators used herein include polymeric photoinitiators and/or oligomer photoinitiators, such as benzoin ethers, benzyl ketals, acetyl phenones, alkyl phenones, phosphine oxides, benzophenone compounds and thioxanthone compounds that include an amine synergist, combinations thereof, and equivalents thereof. For example, in some embodiments photoinitiators include Irgacure® products manufactured by BASF of Ludwigshafen, Germany, or equivalent compositions. Herein, the first and second precursor compositions 363 and 373 are formulated to have a viscosity between about 80 cP and about 110 cP at about 25° C., between about 12 cP and about 30 cP at about 70° C., or between 10 cP and about 40 cP for temperatures between about 50° C. and about 150° C. so that the precursor compositions 363, 373 may be effectively dispensed through the nozzles 335 of the dispensing heads 360, 370.

Herein, the window precursor composition 383 comprises a mixture of one or more acrylate and/or methacrylate based monomers, acrylate and/or methacrylate oligomers, photoinitiators, and/or thermal initiators. Examples of monomers used in the window precursor composition 383 include mono- and di-(meth)acrylic aliphatics or mono urethane-(meth)acrylic aliphatic diluents, such as isobornyl acrylate (IBOA), isobornyl methacrylate, dicyclopentanyl acrylate, dicyclopentanyl methacrylate, tetrahydrofurfuryl acrylate, lauryl acrylate, 2-(((butylamino) carbonyl) oxy) ethyl acrylate, SR420, CN131, dipropylene glycol diacrylate, 1,6-hexanediol acrylate, glycidyl acrylate, derivatives thereof, and combinations thereof.

Examples of oligomers used in the window precursor composition 383 include acrylate and/or methacrylate based oligomers including multi-functional (2-6 of acrylate or methacrylate functional groups) of polyether acrylates, aliphatic polyester acrylates, aliphatic urethane acrylates, and epoxy acrylates. For example, in some embodiments, the acrylate and/or methacrylate based monomers and/or oligomers include CN991, CN964, and CN9009 available from Sartomer Americas Inc. of Exton, Pa., Ebecryl 270, Ebecryl 40 available from Allnex Group Co. in Frankfurt, Germany, Br-744BT and Br-582E8 available from Dymax Corp. of Torrington, Conn., Bac-45 available from Osaka Organic Chemical Industry LTD. of Osaka City, Japan, Exothane 10 available from ESSTECH, Inc. of Essington, Pa., and equivalent compositions thereof.

Typically, photoinitiators and/or thermal initiators used in the window precursor composition 383 are selected to minimize photon absorption by the material of the window feature 208 at wavelengths more than about 350 nm. Examples of photoinitiators used in the window precursor composition 383 include Omnirad 651 (2,2-dimethoxy-2-phenylacetophenone), Omnirad 907 (2-methyl-1-[4-(methylthio)phenyl]-2-morpholinopropan-1-one), Omnirad 184 (1-hydroxycyclohexyl-phenyl ketone), and Esacure KIP 150 (oligomeric alpha hydroxy ketone) manufactured by IGM Resins USA Inc. of Charlotte N.C. and compositional equivalents thereof. In embodiments herein, the photoinitiator comprises less than about 5 wt % of the window precursor composition, such as less than about 1 wt %. Examples of thermal initiators include azobisisobutyronitrile 1,1'-azobis(cyclohexane-1-carbonitrile), benzoyl peroxide, equivalents thereof, and combinations thereof.

In other embodiments, the window precursor composition 383 comprises a mixture of one or more of epoxides, oxetanes, polyols, photoinitiators, and/or thermal initiators. Examples of epoxides include 2-ethylhexyl glycidyl ether, phenyl glycidyl ether, 1,6-hexanediol diglycidyl ether, terephthalic acid diglycidyl ester, bisphenol A diglycidyl ether, derivatives thereof, and combinations thereof. Examples of oxetanes include 3-methyl-3-oxetanemethanol, 3-ethyl-3-phenoxymethyl-oxetane, 1,4-bis[(3-ethyl-3-oxetanylmethoxy)methyl]benzene, bis(1-ethyl(3-oxetanil)methyl) ether, derivatives thereof, and combinations thereof. Examples of polyols include polyester polyols, polyether polyols, and polypropylene polyols.

In some embodiments, the window precursor composition 383 further comprises a photoacid, such as an onium salt based photo acid generators, such as Omnicat 250, Omnicat 440, and Omnicat 550, manufactured by IGM Resins USA Inc. of Charlotte N.C. and compositional equivalents thereof, triphenylsulfonium triflate, and triarylsulfonium salt type photo acid generators such as CPI-210S available from San-Apro Ltd. in Tokyo, Japan, and compositional equivalents thereof.

In some embodiments, the window precursor composition 383 further comprises nanoparticles having a high refractive index such as titanium oxides, zirconium oxides, zirconium acrylates, and hafnium acrylates, for example $TiO_2$, $ZrO_2$, zirconium sulfate, zirconium acrylate, and zirconium bromonorbornanelactone carboxylate triacrylate, and combinations thereof. Generally, high refractive index nanoparticles increase the overall refractive index of the window feature 208 from between about 1.4 and 1.5, when not used, to between about 1.6 and about 1.9, when used. Increasing the refractive index of the window feature 208 reduces reflection from the surface thereof and desirably increases photon transmittance therethrough.

Herein, the window precursor composition is formulated to have a viscosity of between about 50 cP and about 500 cP at 25° C., such as between about 50 cP and about 500 cP at 25° C., so that the window precursor composition is effectively dispensed through the nozzles 335 of the dispensing head 380.

FIG. 3A further illustrates a curing process using the additive manufacturing system 300, according to one embodiment shows a portion of one or more previously formed layers 346 of a polishing pad element, such as the window feature 208. During processing, the dispensing heads 360, 370, 380 deliver a plurality of droplets of one or more precursor compositions, such as the plurality of droplets 343 of the window precursor composition 383 to a surface 346A of the one or more previously formed layers 346. As used herein, the term "curing" includes partially curing the droplets to form a desired layer, as complete curing of the droplets may limit desirable reactions with droplets of subsequently deposited layers. The plurality of droplets 343 form one of a plurality of second sub-layers 348 which includes a cured portion 348A and an uncured portion 348B where the cured portion has been exposed to radiation 321 from the radiation source 320. As shown, the cured portion 348A comprises the reaction product of the window precursor composition 363 having a thickness between about 0.1 micron and about 1 mm, such as between about 5 microns and about 100 microns, for example between about 10 microns and about 30 microns. In some embodiments, curing of droplets of the precursor compositions 363, 373, 383 is performed in an oxygen free or oxygen limited atmosphere, such as a nitrogen or nitrogen rich atmosphere. The oxygen free or oxygen limited atmosphere increases the polymerization reaction kinetics and reactive product yield of the curing process for the acrylate based window precursor composition 383.

FIG. 3B is a close up cross-sectional view of a droplet 343 dispensed onto the surface 346A of the one or more previously formed layers 346 of the window feature 208. Once dispensed onto the surface 346A, the droplet 343 spreads to a droplet diameter 343A having a contact angle $\alpha$. The droplet diameter 343A and contact angle $\alpha$ are a function of at least the material properties of the precursor composition, the energy at the surface 346A (surface energy) of the one or more previously formed layers 346, and time. In some embodiments, the droplet diameter 343A and the contact angle $\alpha$ will reach an equilibrium after a short amount of time, for example less than about one second, from the moment that the droplet contacts the surface 346A of the one or more previously formed layers 346. In some embodiments, the droplets 343 are cured before reaching an equilibrium droplet diameter and contact angle $\alpha$. Typically, the droplets 343 have a diameter of between about 10 and about 200 micron, such as between about 50 micron and about 70 microns before contact with the surface 346A and spread to between about 10 and about 500 micron, between about 50 and about 200 microns, after contact therewith. The surface energy of the one or more previously formed layers 346 and of the cured portion 348B of the second layer 348 herein is between about 30 $mJ/m^2$ and about 45 $mJ/m^2$.

In some embodiments, the window feature 208 is formed using more than one precursor composition. In those embodiments, a plurality of precursor compositions, each having distinct properties upon curing, are dispensed according to a predetermined printing pattern. Upon curing, the resulting material layer has the integrated properties of the plurality of precursor compositions. For example, in one embodiment, droplets of a first window precursor composition that would form a material having a storage modulus E'30 of 1300 MPa are dispensed adjacent to, and interspersed with, droplets of a second window precursor composition that would form a material having a storage modulus E'30 of 8 MPa. When dispensed in a 1:1 ratio the material formed from the first window precursor composition and the second window precursor composition has a E'30 of 500 MPa. Adjusting the ratio of droplets of the first and second window precursor compositions during formation of the window feature 208 allow customization of the material properties thereof without the need for mixing customized precursor compositions.

Figure 4A:
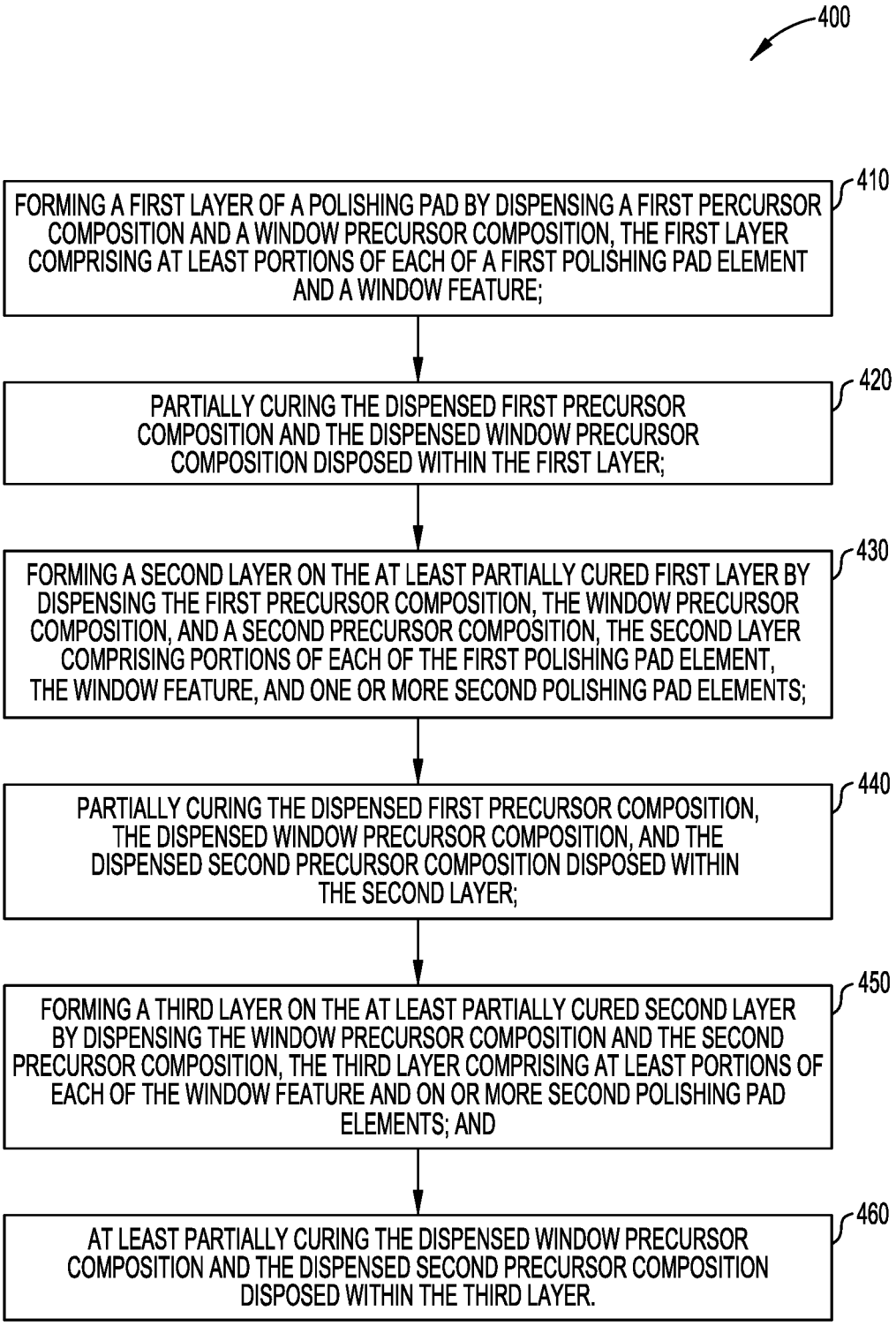
FIG. 4A is a flow diagram setting forth a method of forming a polishing article, such as the polishing pads described in FIGS. 2A-2B, according to one embodiment.
Figure 4B:
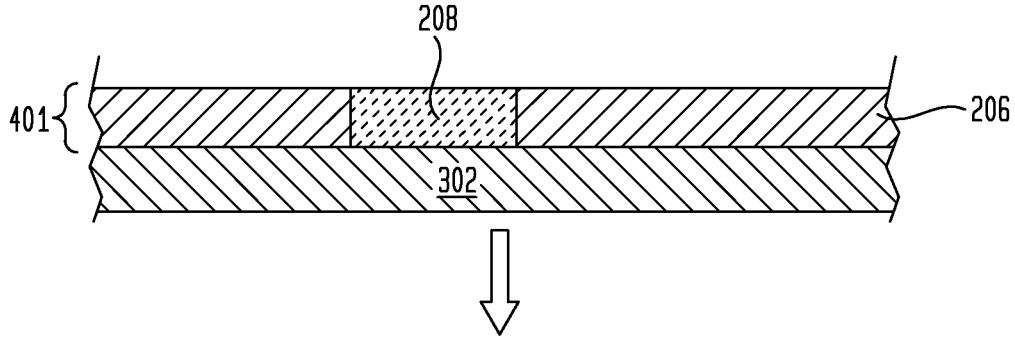
FIGS. 4B-4D illustrate elements of the method set forth in FIG. 4A.
Figure 4C:
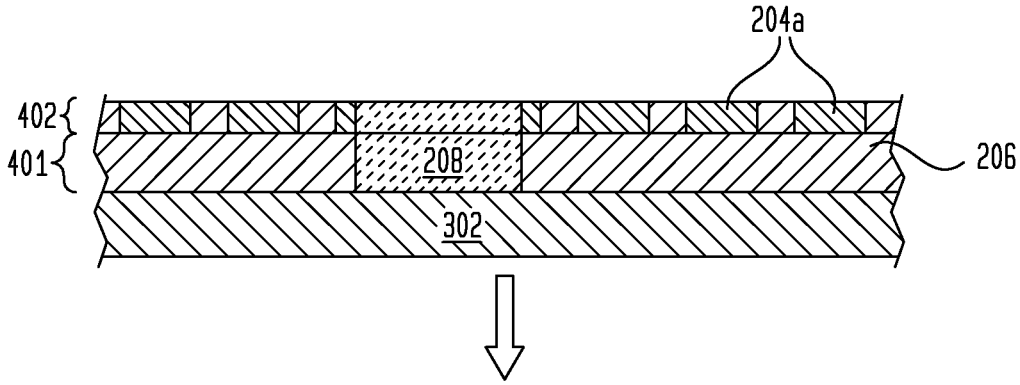
Figure 4D:
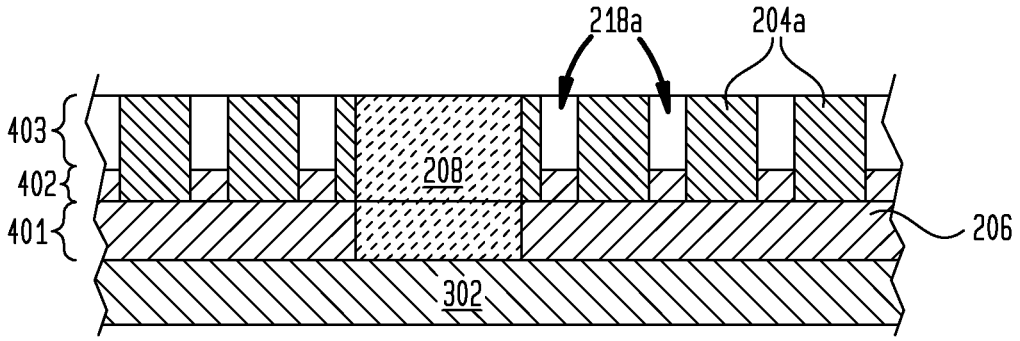

FIG. 4A is a flow diagram setting forth a method 400 of forming a polishing article, such as the polishing pad 200*a* shown in FIGS. 2A-2B according to one embodiment. FIGS. 4B-4D illustrate elements of the method 400.

At activity 410 the method 400 includes forming a first layer 401 of the polishing pad. Here, the first layer 401 includes at least a portion of a sub-polishing element 206 and a portion of the window feature 208, as shown in FIG. 4B. In some embodiments, forming the first layer 401 of the polishing pad includes dispensing a first precursor composition and a window precursor composition to form the at least portions of each of the first layer 401 and the window feature 208 respectively. Here, the precursor compositions are dispensed onto a manufacturing support 302, or onto a previously formed first sub-layer of the first layer 401.

At activity 420 the method 400 includes partially curing the dispensed first precursor composition and the dispensed window precursor composition disposed within the first layer 401. Partially curing layers herein comprises polymerization of the dispensed precursor compositions, typically by exposure of droplets of the precursor compositions to an electromagnetic radiation source, such as a UV radiation source. In some embodiments, forming the first layer 401 includes forming a plurality of first sub-layers where each of the first sub-layers is formed by dispensing a plurality of first droplets of the first precursor composition and a plurality of second droplets of the window precursor composition and at least partially curing the dispensed droplets before forming a next sub-layer thereon.

At activity 430 the method 400 includes forming a second layer 402 on the at least partially cured first layer 401. In some embodiments, the second layer 402 includes at least portions of the first polishing pad element 206, of the window feature 208, and one or more second polishing pad elements 204*a*, as shown in FIG. 4C. Here, forming the second layer 402 includes dispensing the first precursor composition, the window precursor composition, and a second precursor composition to form at least portions of each of the sub-polishing element 206, of the window feature 208, and of the one or more second polishing pad elements 204*a* respectively.

At activity 440 the method 400 includes partially curing the second layer. In some embodiments, forming the second layer 402 includes forming a plurality of second sub-layers where each second sub-layer is formed by dispensing a plurality of first droplets of the first precursor composition, a plurality of second droplets of the window precursor composition, and a plurality of third droplets of the second precursor composition. In those embodiments, forming each second sub-layer includes at least partially curing the dispensed droplets before forming a next sub-layer thereon. In another embodiment, the method 400 does not include activities 430 and 440.

At activity 450 the method 400 includes forming a third layer 403 on the at least partially cured second layer 402. In some embodiments, the third layer 403 includes at least portions of each of the window feature 208 and the one or more second polishing pad elements 204*a*, as shown in FIG. 4D. Forming the third layer 403 includes dispensing the second precursor composition and dispensing the window precursor composition to form the at least portions of each of the one or more second polishing pad elements 204*a* and the window feature 208 respectively. In some embodiments, forming the third layer 403 includes forming a plurality of third sub-layers where each third sub-layer is formed by dispensing a plurality of second droplets of the window precursor composition and a plurality of third droplets of the second precursor composition and at least partially curing the dispensed droplets before forming a next sub-layer thereon. In other embodiments, the third layer 403 is formed directly on the first layer 401.

At activity 460 the method 400 includes at least partially curing the dispensed window precursor composition and the dispensed second precursor composition disposed within the third layer.

Typically, the first, second, and third droplets form chemical bonds at the interfaces thereof during partially curing of each of the sub-layers and further form chemical bonds with the partially cured precursor compositions of a previously formed sub-layer. In some embodiments herein, the sub-polishing element 206, the window feature 208, and the plurality of polishing elements 204*a* form a continuous polymer phase having discrete material properties within each element and feature.

Typically, each of the droplets used to form portions of the window feature 208 in the first layer 401, second layer 402, and the third layer 403 are partially cured by a curing device after, or simultaneously with, the dispensing thereof. Partially curing the droplets after, or simultaneously with, the dispensing thereof allows for the droplets to be substantially fixed in place and shape so they do not move or change their shape as subsequent droplets are deposited adjacent to, or upon, them. Partially curing the droplets also allows for control of the surface energy of each layer, and thus control of the contact angle of subsequently deposited droplets thereupon.

Figure 5A:
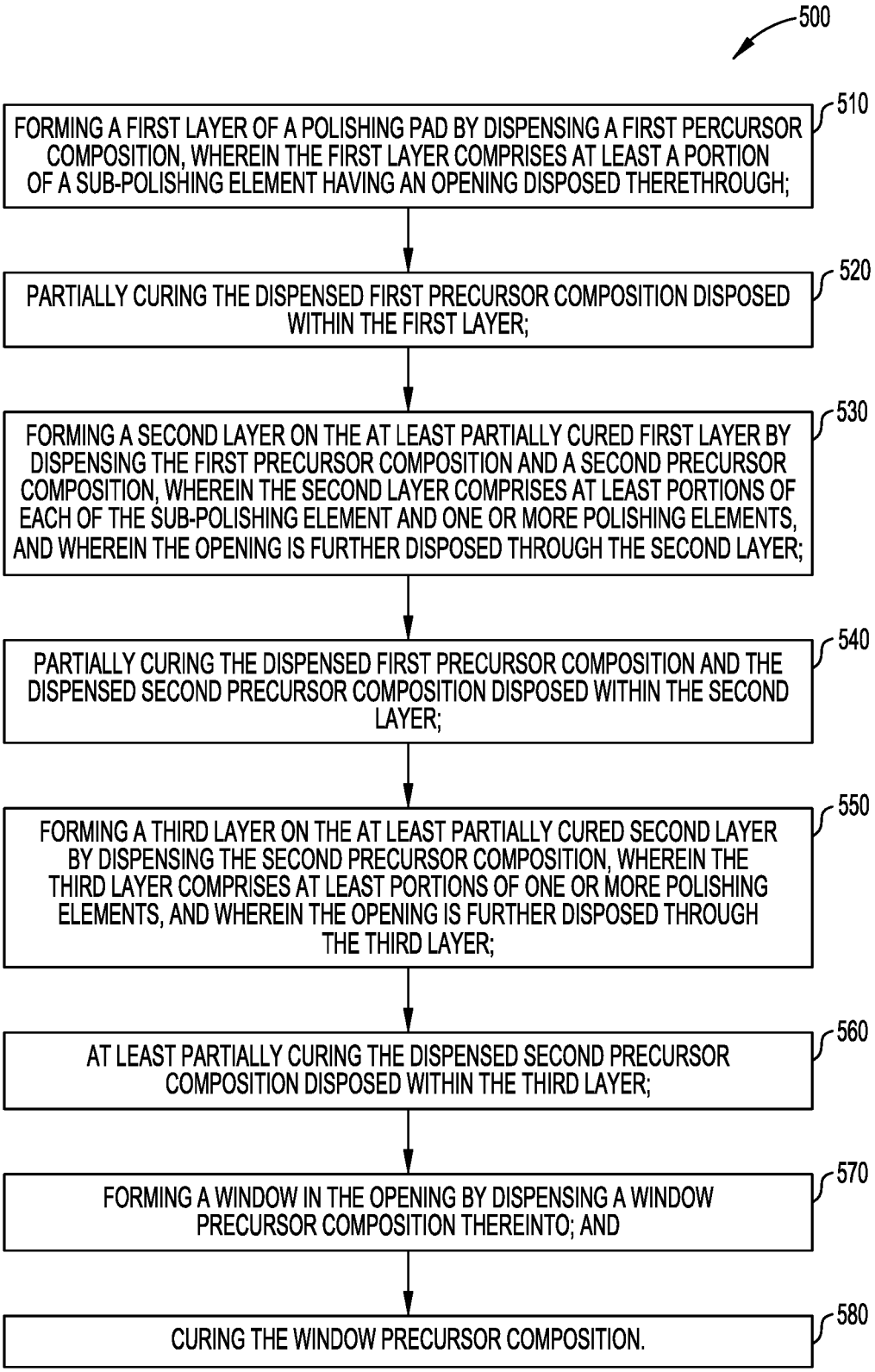
FIG. 5A is a flow diagram setting forth a method of forming a polishing pad, such as the polishing pad shown in FIGS. 2A-2B, according to another embodiment.

FIG. 5A is a flow diagram setting forth a method 500 of forming a polishing pad, such as the polishing pad 200*a* shown in FIGS. 2A-2B, according to one embodiment. FIGS. 5B-5F illustrate elements of one embodiment of the method 500. FIGS. 5G-5K illustrate elements of another embodiment of the method 500.

Figure 5B:
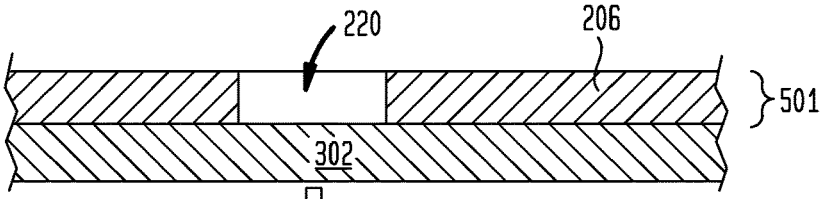
FIGS. 5B-5F illustrate elements of the method set forth in FIG. 5A, according to one embodiment.

At activity 510 the method 500 includes forming a first layer 501 of a polishing pad. Here, the first layer 501 comprises at least a portion of a sub-polishing element 206 having an opening 220 disposed therethrough, as shown in FIG. 5B. In some embodiments, forming the first layer 501 includes dispensing a first precursor composition to form a portion of the sub-polishing element 206. Here, the opening 220 is formed by dispensing the first precursor composition about a desired perimeter thereof.

At activity 520 the method includes partially curing the dispensed first precursor composition within the first layer 501. Partially curing the layers herein comprises polymerization of the dispensed precursor compositions, typically by exposure of droplets of the precursor compositions to an electromagnetic radiation from an electromagnetic radiation source, such as UV radiation from a UV source.

In some embodiments, forming the first layer 501 includes forming a plurality of first sub-layers where each of the first sub-layers is formed by dispensing a plurality of first droplets of the first precursor composition and at least partially curing the dispensed droplets before forming a next sub-layer thereon.

Figure 5C:
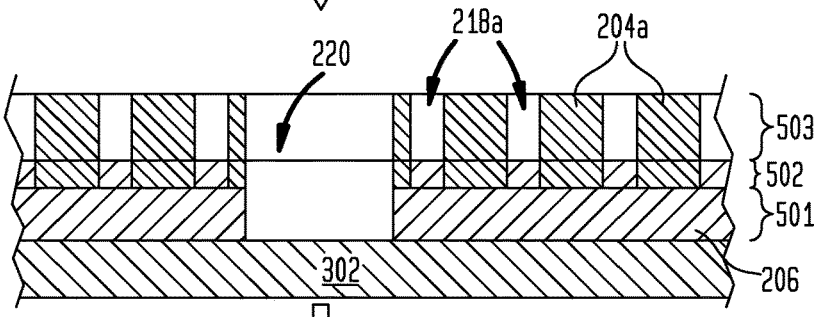

At activity 530 the method 500 includes forming one or more second layers 502 on the at least partially cured first layer 501. Here, the one or more second layers 502 comprises at least a portion of the sub-polishing element 206 and portions of the plurality of polishing elements 204*a*, as shown in FIG. 5C. Forming the second layer 502 comprises dispensing the first precursor composition and dispensing a second precursor composition to form portions of the sub-polishing element 206 and portions of the plurality of polishing elements 204*a* respectively. Herein, the opening 220 defined in forming the first layer 501 is further disposed through the second layer 502.

At activity 540 the method 500 includes partially curing the dispensed first precursor composition and the dispensed second precursor composition disposed within the second layer 502.

In some embodiments, forming the second layer 502 includes forming a plurality of second sub-layers where each second sub-layer is formed by dispensing a plurality of first droplets of the first precursor composition and a plurality of second droplets a second precursor composition and at least partially curing the dispensed droplets before forming a next sub-layer thereon. In other embodiments, the method 500 does not include activities 530 and 540.

At activity 550 the method 500 includes forming a third layer 503 on the at least partially cured second layer 502, where the third layer 503 comprises portions of the plurality of polishing elements 204*a*, as shown in FIG. 5C. Forming the third layer 503 comprises dispensing the second precursor composition to form at least portions of the one or more polishing elements 204*a*.

At activity 560 the method 500 includes at least partially curing the dispensed second precursor composition disposed within the third layer 503. Typically, the dispensed second precursor composition disposed within the third layer is at least partially cured using a curing source, such as an electromagnetic radiation source, for example a UV radiation source.

In some embodiments, forming the third layer 503 includes forming a plurality of third sub-layers where each of the third sub-layers is formed by dispensing a plurality of second droplets a second precursor composition and at least partially curing the dispensed droplets before forming a next sub-layer thereon. In other embodiments, the third layer 503 is formed directly on the first layer 501.

Figure 5D:
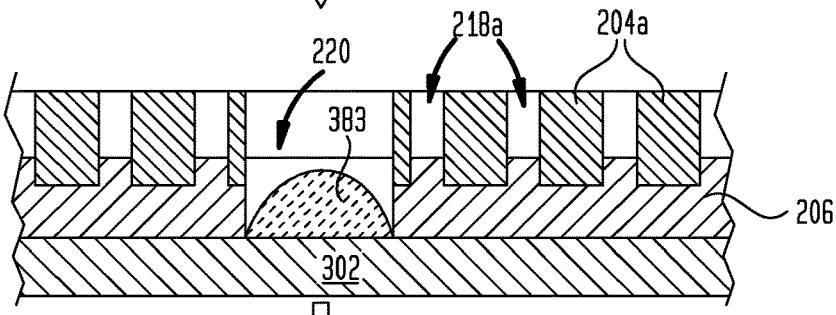
Figure 5E:
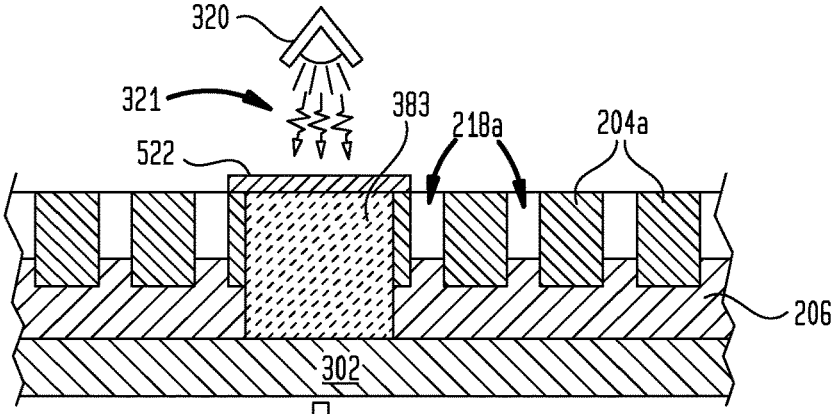
Figure 5F:
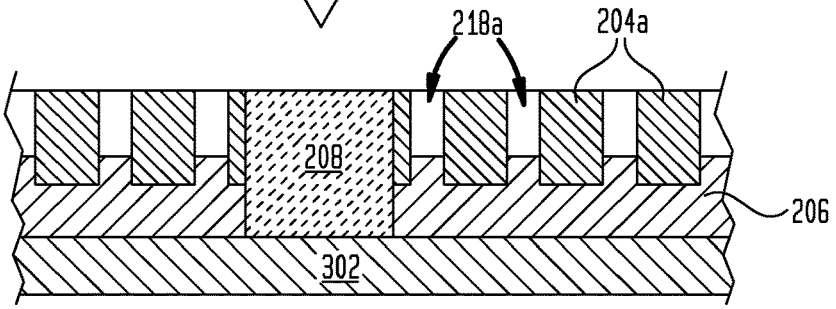
Figure 5G:
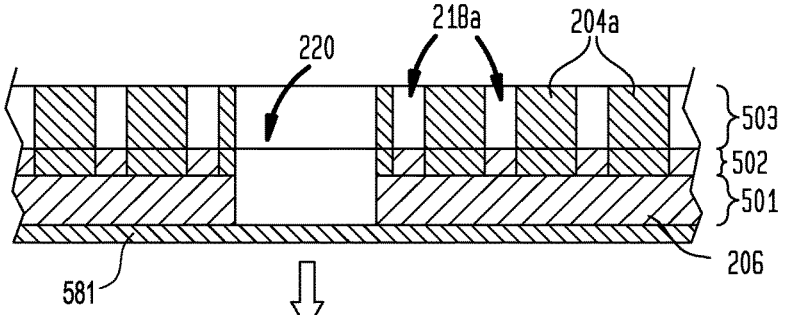
FIGS. 5G-5J illustrate elements of the method set forth in FIG. 5A, according to another embodiment.
Figure 5H:
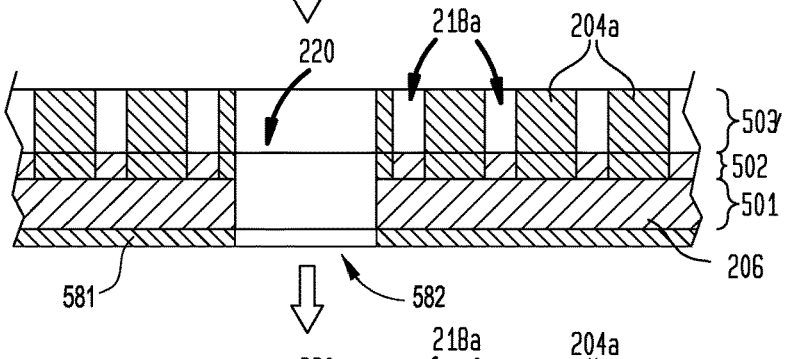
Figure 5I:
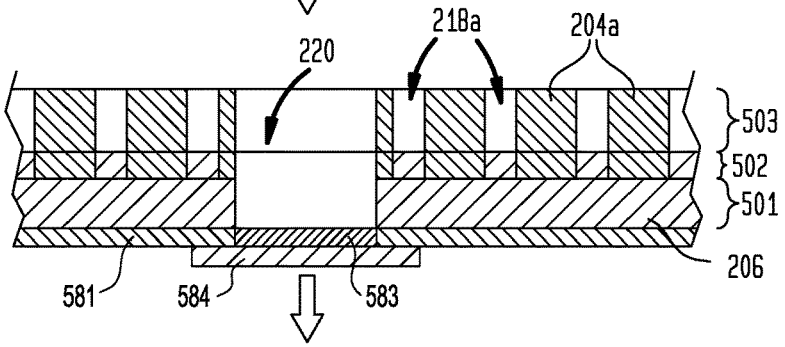
Figure 5J:
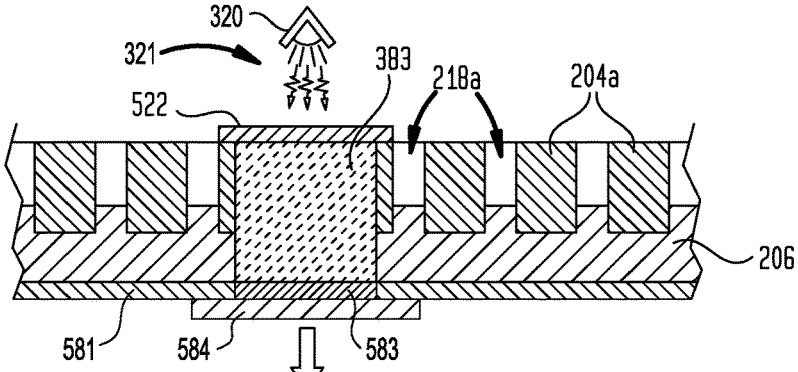

At activity 570 the method 500 includes dispensing a window precursor composition 383 into the opening 220. At activity 580 the method 500 further includes curing the window precursor composition 383 to form the window feature 208. FIGS. 5D-5F illustrate elements of activities 570 and 580 according to one embodiment of the method 500. FIGS. 5G-5J illustrate elements of activities 570 and 580 according to another embodiment of the method 500.

In one embodiment, such as shown in FIGS. 5D-5F, the window precursor composition 383 is dispensed into the opening 220 and cured while the polishing pad remains on the manufacturing support 302. Typically, the opening 220 is bounded by the at least partially cured precursor compositions used to form the plurality of polishing elements 204*a* and the sub-polishing element 206. In some embodiments, the at least partially cured precursor compositions comprise unreacted (un-polymerized) termination sites at the inner surfaces of the polishing pad material defining the opening 220. For example, in some embodiments, the at least partially cured precursor composition comprise acrylate terminated surface sites at the inner walls defining the opening 220, such as shown in (A) where R represents a polymerized precursor composition at the inner surface of the opening 220.

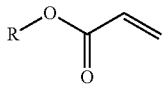

(A)

As shown in FIG. 5E, the window precursor composition 383 is dispensed to a level planer with a polishing surface of the polishing pad. Here, curing the window precursor composition 383 comprises polymerization thereof by exposure to radiation 321 from a radiation source 320, such as UV radiation from a UV lamp or UV LED lamp, as shown in FIG. 5E. In other embodiments, curing the window precursor composition 383 comprises polymerization thereof by thermal curing, for example by heating the window precursor composition 383 to a temperature between about 70° C. and about 100° C. for between about 30 minutes and about 3 hours. In some embodiments, such as shown in FIG. 5E, the method 500 further includes positioning a UV optically transparent polymer sheet 522, such as a UV optically transparent polyolefin, polyacrylic, or polycarbonate sheet, on the dispensed window precursor composition 383 before the curing activity 570 and removing the optically transparent polymer sheet 522 thereafter, resulting in the structure of FIG. 5F. Typically, curing the window precursor composition 383 comprises reacting the window precursor composition 383 with unreacted termination sites, e.g., acrylate terminated surface sties, at the inner walls defining the opening 220. In those embodiments, the cured window precursor composition 383 forms a continuous polymer phase with the polishing pad material defining the opening 220.

In another embodiment, such as shown in FIG. 5G-5J, the method 500 further includes removing the partially formed polishing pad from the manufacturing support 302 (shown in FIG. 5E-5F) and positioning an adhesive layer 581 thereon. Typically, the adhesive layer 581 is a pressure sensitive adhesive (PSA) sheet which will be used to secure the polishing pad to a polishing platen for use in a subsequent substrate polishing process. When an adhesive layer 581 is used, the method 500 further includes forming an opening therein, such as the opening 582 shown in FIG. 5H. Here, the opening 582 formed in the adhesive layer 581 is in registration with the opening 220 formed in the polishing pad. Typically, the opening 582 is formed using mechanical means, for example by using punch having a desired top-down cross-sectional shape.

Once the opening 582 is formed in the adhesive layer 518 a delamination insert 583 (shown in FIG. 5J) typically having the same top-down cross-sectional shape as the opening 582. Typically, the delamination insert 583 has a thickness of between about 5 μm and less than the thickness of the polishing pad which may be varied to a desired thickness of a to be formed window feature. Here, the delamination insert 583 is positioned in the opening 582 and held in place relative to the mounting surface of the polishing pad by a temporary adhesive tape 584. The delamination insert 583 and the temporary adhesive tape 584 seal the mounting surface of the polishing pad to prevent the window precursor composition from flowing out of the opening 582 during the subsequent formation of the window feature 208. Herein, the delamination insert 583 may be formed on any one of a polymer, metal, metalloid, ceramic, glass, or a combination thereof. In some embodiments, the delamination insert 583 has a relatively low roughness (e.g., high gloss) hydrophobic surface with relatively low surface tension. Generally, using lower roughness, e.g., RMS roughness <300 nm, hydrophobic low tension, e.g., <20 dynes/cm, surfaces for the delamination insert 583, when compared to higher roughness hydrophilic high tension surfaces, results in a lower roughness base surface of a to be formed window feature 208 and thus desirably increased light transmittance therethrough.

Once the delamination insert 583 is positioned in the opening 582 the window precursor composition is flowed into the opening 220 as described above in activity 570 and cured as described above in activity 580 and shown in FIG. 5J. The delamination insert 583 is then removed from the opening 582 to form the polishing pad (shown in FIG. 5K).

Figure 5K:
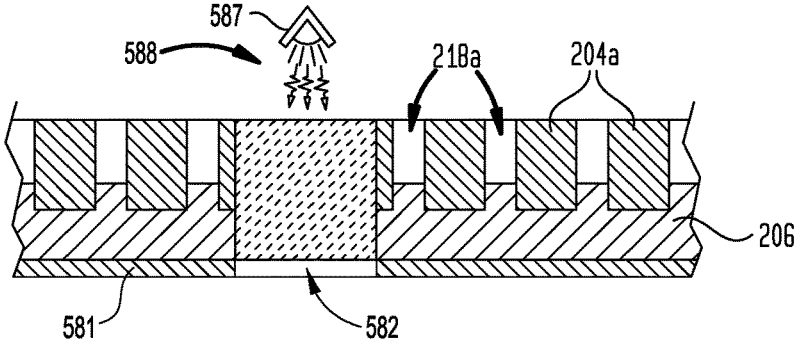
FIG. 5K illustrates elements of further embodiments of the methods set forth in FIGS. 4A and 5A.

FIG. 5K illustrates a further embodiment of the methods set forth herein, such as the methods 400 and 500. In FIG. 5K the cured window feature 208 is exposed to UV radiation 588 from a broadband UV radiation source 587 to pre-age or pre-discolor the window feature 208. Pre-aging or pre-discoloring the window feature 208 desirably reduces changes the optical transmittance thereof across a useful lifetime of the polishing pad. Typically, changes in the optical transmittance of the window feature are due to photo-degradation of the window feature materials. The photo-degradation may be caused by exposure to ambient light in a manufacturing facility after the polishing pad is mounted on a polishing platen of a polishing system, from light transmitted through the window feature by an endpoint detection system, or both. Changes in the discoloration of the window feature material across the useful polishing pad lifetime may cause undesirable substrate processing variation due to variability in end point detection times related thereto. In some embodiments, the UV broadband radiation source 587 provides radiation across at least a portion of the UV spectrum including wavelengths from about 200 nm to about 450 nm, or less than about 450 nm. Typically, the UV radiation 588 has an intensity of between about 50 $mW/cm^2$ and about 5000 $mW/cm^2$. In some embodiments, the window feature 208 is exposed to the UV radiation for between about 30 sec and about 300 sec, for example about 60 sec.

Figure 6A:
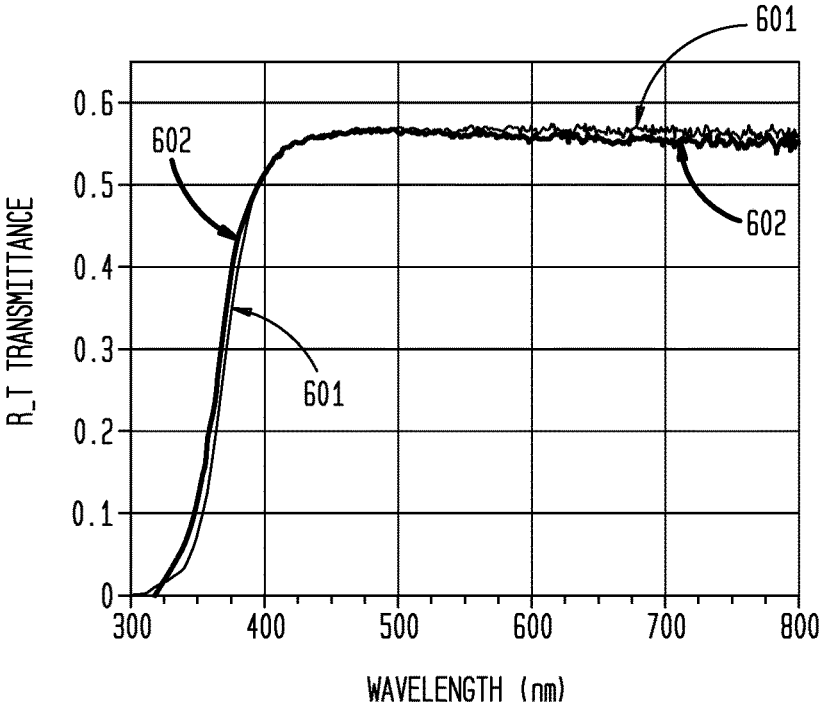
FIGS. 6A-6C illustrate optical transparency and discoloration properties of a window feature formed according to the embodiments described herein.
Figure 6B:
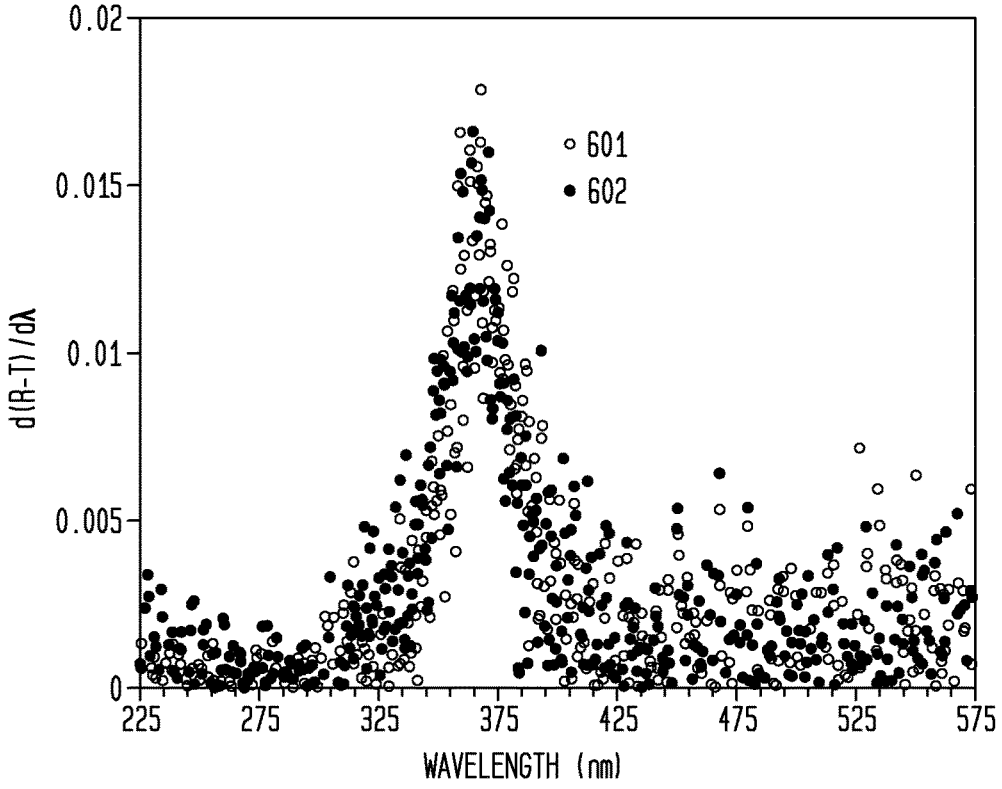
Figure 6C:
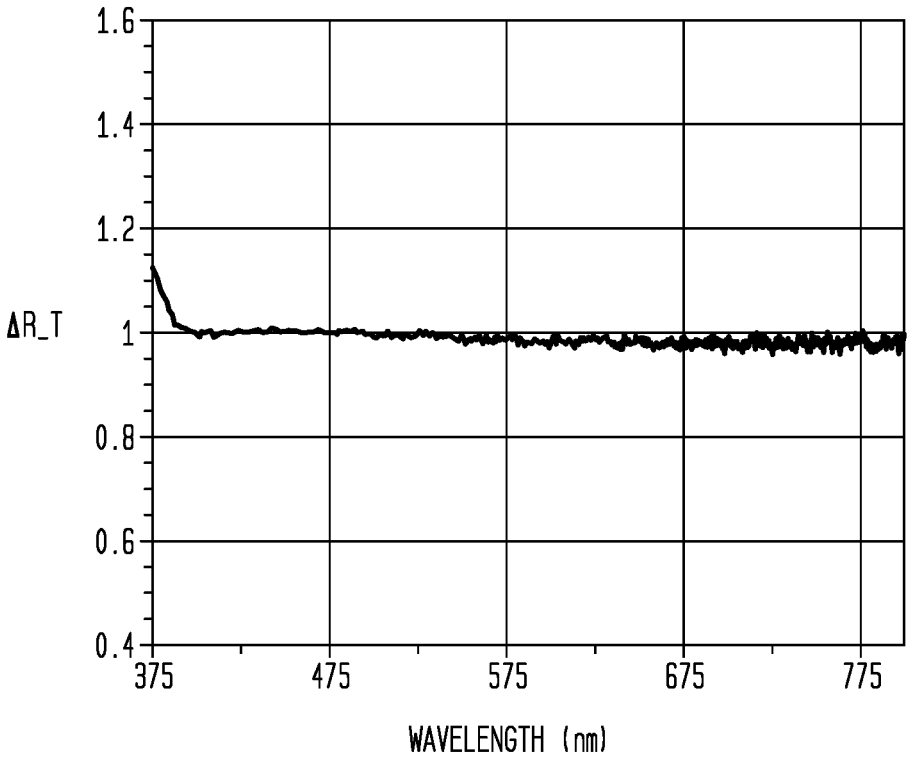

FIGS. 6A-6C illustrate various optical properties of window features formed according to embodiments herein. FIG. 6A illustrates the optical transparency of a window feature formed according to embodiments described herein. As shown in FIG. 6A a window feature, such as window feature 208, shows the normalized reflectance transmission (R_T) of the material of a window feature 208 at the beginning of the polishing pad lifetime as curve 601 and at the end of the polishing pad lifetime as curve 602. Herein, the material of the window feature 208 exhibits optical transparency to light at wavelengths between about 375 nm and more than about 800 nm across the polishing pad lifetime as indicated by normalized R_T values greater than about 0.2.

FIG. 6B illustrates an R_T cutoff of the window feature shown in FIG. 6A. Herein, the R_T cutoff value is the wavelength of light in which the first derivative of the R_T curves shown in FIG. 6A reaches a maximum between no transmittance to maximum transmittance. Herein, the R_T cutoff of the window feature 208 at the beginning the polishing pad lifetime (curve 601) and at the end of the polishing pad lifetime (curve 602) is between about 350 nm and about 380 nm, such as between about 360 nm and about 370 nm, for example about 365 nm.

FIG. 6C illustrates the discoloration of the window feature material shown in FIGS. 6A-6B across the useful polishing pad lifetime. Herein, the window feature material shows less than about 10% deviation in ΔR_T between about 375 nm and about 800 nm between the beginning and end of the useful polishing pad lifetime, where ΔR_T is the ratio of R_T transmission at the end of the polishing pad lifetime to the R_T transmission at the beginning of the polishing pad lifetime. In embodiments where the window feature material is pre-aged or pre-discolored by exposure to broadband UV radiation, such as described above in FIG. 5K, the window feature material has less than about 5% deviation in ΔR_T between about 350 nm and about 800 nm from the beginning to the end of the useful polishing pad lifetime.

Embodiments described herein provide for polishing pads having acrylate based window features, and methods of forming polishing pads with acrylate based window features. The acrylate based window features are compatible with optical endpoint detection systems, and desirable material properties of the window features are easily tuned during the manufacturing process thereof. Typically, the window feature is integrally formed with the material of the polishing pad so that the regions, elements, and features thereof form a continuous polymer phase with the regions, elements, or features having unique properties and attributes from each other.

While the foregoing is directed to embodiments of the present disclosure, other and further embodiments of the disclosure may be devised without departing from the basic scope thereof, and the scope thereof is determined by the claims that follow.

The invention claimed is:

1. A method of forming a polishing pad, comprising:

forming a first layer of the polishing pad by dispensing a first precursor composition and a window precursor composition, the first layer comprising at least portions of each of a first polishing pad element and a window feature; and partially curing the dispensed first precursor composition and the dispensed window precursor composition to form an at least partially cured first layer.

2. The method of claim 1, further comprising:

forming a second layer on the at least partially cured first layer by dispensing the window precursor composition and a second precursor composition, wherein the second layer comprises at least portions of each of the window feature and one or more second polishing pad elements; and partially curing the dispensed window precursor composition and the dispensed second precursor composition disposed within the second layer.

3. The method of claim 2, wherein forming the second layer comprises forming a plurality of second sub-layers, each of the plurality of second sub-layers formed by dispensing droplets of the window precursor composition and droplets of the second precursor composition, wherein the droplets of the window precursor composition and the droplets of the second precursor composition form chemical bonds at the interfaces thereof during partially curing of each of the plurality of second layers.

4. The method of claim 2, wherein forming the second layer on the at least partially cured first layer further comprises dispensing the first precursor composition, wherein the second layer further comprises at least portions of one or more first polishing pad elements; and partially curing the dispensed first precursor composition disposed within the second layer.

5. The method of claim 4, further comprising:

forming a third layer on the at least partially cured second layer by dispensing the window precursor composition and the second precursor composition, wherein the third layer comprises at least portions of each of the window feature and one or more second polishing pad elements; and partially curing the dispensed window precursor composition and the dispensed second precursor composition disposed within the second layer.

6. The method of claim 5, wherein forming the third layer comprises forming a plurality of third sub-layers, each of the plurality of third sub-layers formed by dispensing droplets of the window precursor composition and droplets of the second precursor composition, wherein the droplets of the window precursor composition and the droplets of the second precursor composition form chemical bonds at the interfaces thereof during the partial curing of each of the plurality of third sub-layers.

7. The method of claim 1, wherein the forming the first layer comprises forming a plurality of first sub-layers, each of the plurality of first sub-layers formed by dispensing droplets of the first precursor composition and droplets of the window precursor composition, and wherein droplets of the first precursor composition and droplets of the window precursor composition form chemical bonds at the interfaces therebetween during partial curing of each the plurality of first sub-layers.

8. The method of claim 7, wherein the window precursor composition comprises a first component selected from the group consisting of an acrylate based monomer, a methacrylate based monomer, an acrylate based oligomer, a methacrylate based oligomer, or combinations thereof.

9. The method of claim 8, wherein the window precursor composition further comprises a second component selected from the group consisting of 2,2-dimethoxy-2-phenylacetophenone, 2-methyl-1-[4-(methylthio)phenyl]-2-morpholinopropan-1-one, 1-hydroxycyclohexyl-phenyl ketone, oligomeric alpha hydroxy ketones, and combinations thereof.

10. The method of claim 7, wherein the window precursor composition comprises a first component selected from the group consisting of isobornyl acrylate, isobornyl methacrylate, dicyclopentanyl acrylate, dicyclopentanyl methacrylate, tetrahydrofurfuryl acrylate, lauryl acrylate, 2-(((butylamino) carbonyl) oxy) ethyl acrylate, SR420, CN131, dipropylene glycol diacrylate, 1,6-hexanediol acrylate, glycidyl acrylate, multi-functional groups of polyether acrylates, multi-functional groups of polyester acrylates, multi-functional groups urethane acrylates, multi-functional groups epoxy acrylates, and combinations thereof.

11. The method of claim 10, wherein the window precursor composition further comprises nanoparticles selected from the group consisting of titanium oxides, zirconium oxides, zirconium sulfate, zirconium acrylates, hafnium acrylates, and combinations thereof.

12. The method of claim 11, wherein the first polishing element, the window feature, and the one or more second polishing elements form a continuous polymer phase.

13. The method of claim 1, wherein partially curing the dispensed first precursor composition and the dispensed window precursor composition is performed in an oxygen-free or oxygen-limited atmosphere.

14. A method of forming a polishing pad, comprising:

forming a first layer of the polishing pad by dispensing a first precursor composition wherein the first layer comprises at least a portion a sub-polishing element having a first opening disposed therethrough;

partially curing the dispensed first precursor composition to form an at least partially cured first layer;

forming a second layer on the at least partially cured first layer by dispensing a second precursor composition, wherein the second layer comprises one or more polishing elements and the first opening is further disposed through the second layer;

partially curing the dispensed second precursor composition within the second layer; and forming a window feature in the first opening by dispensing a window precursor composition thereinto and curing the window precursor composition.

15. The method of claim 14, further comprising positioning a UV optically transparent polymer sheet on the window precursor composition before curing thereof.

16. The method of claim 14, wherein curing the window precursor composition comprises heating thereof to a temperature between about 70° C. and about 100° C.

17. The method of claim 14, wherein curing the window precursor composition comprises exposing the window precursor composition to UV radiation.

18. The method of claim 14, wherein curing the window precursor composition comprises exposing the window precursor composition to broadband UV radiation for between about 30 sec and about 300 sec.

19. The method of claim 14, wherein forming the window feature further comprises:

securing an adhesive layer to a platen-mounting surface of the first layer, wherein the first opening is disposed in registration with a second opening formed through the adhesive layer;

positioning a delamination insert in the second opening, wherein the delamination insert seals the second opening to prevent the dispensed window precursor composition from flowing out therefrom.

20. A method of forming a polishing pad, comprising:

forming a first layer of the polishing pad by dispensing a first precursor composition from a first dispense head and a window precursor composition from a second dispense head, the first layer comprising at least portions of each of a first polishing pad element and a window feature; and partially curing the dispensed first precursor composition and the dispensed window precursor composition to form an at least partially cured first layer.

* * * * *